US011124962B2

(12) United States Patent
Andresen et al.

(10) Patent No.: US 11,124,962 B2
(45) **Date of Patent: *Sep. 21, 2021**

(54) DYNAMIC, FIRE-RESISTANCE-RATED THERMALLY INSULATING AND SEALING SYSTEM HAVING A F-RATING OF 120 MIN FOR USE WITH CURTAIN WALL STRUCTURES

(71) Applicant: Hilti Aktiengesellschaft, Schaan (LI)

(72) Inventors: Arndt Andresen, North Richland Hills, TX (US); Matthew Zemler, Corinth, TX (US); Chad Stroike, Roanoke, TX (US)

(73) Assignee: Hilti Aktiengesellschaft, Schaan (LI)

( * ) Notice: Subject to any disclaimer, the term of this patent is extended or adjusted under 35 U.S.C. 154(b) by 10 days.

This patent is subject to a terminal disclaimer.

(21) Appl. No.: 16/610,434

(22) PCT Filed: May 18, 2018

(86) PCT No.: PCT/EP2018/063087

§ 371 (c)(1),
(2) Date: Nov. 1, 2019

(87) PCT Pub. No.: WO2018/211070

PCT Pub. Date: Nov. 22, 2018

(65) Prior Publication Data

US 2020/0056372 A1 Feb. 20, 2020

Related U.S. Application Data

(63) Continuation of application No. 15/600,295, filed on May 19, 2017, now Pat. No. 10,202,759.

(51) Int. Cl.
*E04B 1/76* (2006.01)
*E04B 1/94* (2006.01)
(Continued)

(52) U.S. Cl.
CPC ..... *E04B 1/7675* (2013.01); *E04B 1/7616* (2013.01); *E04B 1/7625* (2013.01);
(Continued)

(58) Field of Classification Search
None
See application file for complete search history.

(56) References Cited

U.S. PATENT DOCUMENTS

| | | | |
|---|---|---|---|
| 3,786,604 | A | 1/1974 | Kramer |
| 4,449,341 | A | 5/1984 | Taglianetti et al. |

(Continued)

FOREIGN PATENT DOCUMENTS

| | | |
|---|---|---|
| GB | 2503465 | 1/2014 |
| JP | 2011-190614 | 9/2011 |
| JP | 2012-225802 | 11/2012 |

OTHER PUBLICATIONS

International Search Report dated Aug. 30, 2018 in PCT/EP2018/063087.
Written Opinion dated Aug. 30, 2018 in PCT/EP2018/063087.

*Primary Examiner* — Joshua K Ihezie
(74) *Attorney, Agent, or Firm* — Grüneberg and Myers PLLC

(57) ABSTRACT

An approved dynamic construction is used for effectively thermally insulating and sealing of a safing slot between a floor of a building and an exterior wall construction, wherein the exterior wall construction includes a curtain wall configuration defined by an interior wall glass surface including one or more aluminum framing members, wherein the vision glass extends to the finished floor level below. The dynamic, thermally insulating and sealing system includes a first element for receiving the insulating elements and positioned in the zero spandrel area of a glass curtain wall construction including only vision glass to maintain thermally insulating and sealing of the safing slot during exposure to fire and heat
(Continued)

as well as movement in order to maintain a complete seal extending across the safing slot.

20 Claims, 10 Drawing Sheets

(51) Int. Cl.
*E04B 2/90* (2006.01)
*E04B 1/68* (2006.01)
*E04B 1/84* (2006.01)

(52) U.S. Cl.
CPC ..... *E04B 1/948* (2013.01); *E04B 2/90* (2013.01); *E04B 1/6815* (2013.01); *E04B 1/7612* (2013.01); *E04B 1/94* (2013.01); *E04B 2001/8438* (2013.01)

(56) References Cited

U.S. PATENT DOCUMENTS

| | | | | |
|---|---|---|---|---|
| 4,669,240 | A | 6/1987 | Amormino | |
| 4,873,805 | A | 10/1989 | Ting | |
| 5,502,937 | A | 4/1996 | Wilson | |
| 5,765,332 | A * | 6/1998 | Landin | E04B 1/948 52/235 |
| 7,424,793 | B1 | 9/2008 | Shriver | |
| 7,644,549 | B2 | 1/2010 | Speck | |
| 7,856,775 | B2 | 12/2010 | Stahl, Jr. | |
| 8,671,645 | B1 | 3/2014 | Shriver | |
| 8,683,763 | B2 | 4/2014 | Shriver | |
| 9,016,014 | B2 | 4/2015 | Shriver | |
| 2007/0204540 | A1 | 9/2007 | Stahl, Sr. et al. | |
| 2009/0126297 | A1 | 5/2009 | Stahl, Jr. | |
| 2010/0107532 | A1 | 5/2010 | Shriver | |
| 2013/0061544 | A1 | 3/2013 | Stahl, Jr. et al. | |
| 2013/0097948 | A1 | 4/2013 | Burgess | |
| 2015/0240488 | A1 | 8/2015 | Evensen et al. | |
| 2016/0356034 | A1 | 12/2016 | Andresen | |
| 2017/0145685 | A1 | 5/2017 | Andresen | |
| 2018/0163397 | A1 | 6/2018 | Long et al. | |

* cited by examiner

DYNAMIC, FIRE-RESISTANCE-RATED THERMALLY INSULATING AND SEALING SYSTEM HAVING A F-RATING OF 120 MIN FOR USE WITH CURTAIN WALL STRUCTURES

This application is a National Stage entry under §371 of International Application No. PCT/EP2018/063087, filed on May 18, 2018, and which claims the benefit of US Utility Application No. 15/600,295, filed on May 19, 2017.

FIELD OF THE INVENTION

The present invention relates to the field of constructions, assemblies and systems designed to thermally and acoustically insulate and seal a safing slot area defined between a curtain wall and the individual floors of a building. In particular, the present invention relates to a dynamic, fire-resistance-rated thermally insulating and sealing system having a F-Rating of 120 min for use with curtain wall structures which include glass, especially vision glass extending to the finished floor level below. Further, the present invention relates to a dynamic, thermally insulating and sealing system, parts of which provide a pre-fabricated device for use within a unitized panel construction.

BACKGROUND OF THE INVENTION

Curtain walls are generally used and applied in modem building constructions and are the outer covering of said constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

A curtain wall generally transfers horizontal wind loads that are incident upon it to the main building structure through connections at floors or columns of the building. Curtain walls are designed to resist air and water infiltration, sway induced by wind and seismic forces acting on the building and its own dead load weight forces. Curtain walls differ from store-front systems in that they are designed to span multiple floors, and take into consideration design requirements such as thermal expansion and contraction, building sway and movement, water diversion, and thermal efficiency for cost-effective heating, cooling, and lighting in the building.

However, architects and the public at large appreciate the aesthetics of glass and other light-transmitting materials used in the built environment. Light-transmitting materials, that serve both an aesthetic function as well as a structural function, are appreciated for their economy and visual effects. A common means prescribed by architects to achieve these goals in building structures is through the use of glass curtain wall systems.

A typical glass curtain wall structure is designed with extruded aluminum members. The aluminum frame is typically infilled with glass, which provides an architecturally pleasing building, as well as benefits such as daylighting. Usually, for commercial construction, ¼ inch glass is used only in spandrel areas, while 1 inch insulating glass is used for the rest of the building. In residential construction, thicknesses commonly used are ⅛ inch glass in spandrel areas and ⅝ inch glass as insulating glass. Larger thicknesses are typically employed for buildings or areas with higher thermal, relative humidity, or sound transmission requirements. However, outside-inside sound transmission correlation is usually relevant for all type of residential buildings.

With a curtain wall, any glass may be used which can be transparent, translucent, or opaque, or in varying degrees thereof. Transparent glass usually refers to vision glass in a curtain wall. Spandrel or vision glass may also contain translucent glass, which could be for security or aesthetic purposes. Opaque glass is used in areas to hide a column or spandrel beam or shear wall behind the curtain wall. Another method of hiding spandrel areas is through shadow box construction, i.e. providing a dark enclosed space behind the transparent or translucent glass. Shadow box construction creates a perception of depth behind the glass that is sometimes desired. Aesthetic design and performance levels of curtain walls can be extremely varied. Frame system widths, depths, anchoring methods, and accessories have grown diverse due to industry and design innovation.

In general, a glass curtain wall structure or glass curtain wall construction is defined by an interior wall glass surface including one or more framing members and at least one floor spatially disposed from the interior wall surface. The gap between the floor and the interior wall surface of a curtain wall defines a safing slot, also referred to as perimeter slab edge (void), extending between the interior wall surface of the curtain wall construction and the outer edge of the floor. This safing slot is essential to slow the passage of fire and combustion gases between floors. Therefore, it is of great importance to improve fire stopping at the safing slot in order to keep heat, smoke and flames from spreading from one floor to an adjacent floor. It is important to note that the firestop at the perimeter slab edge is considered a continuation of the fire-resistance-rating of the floor slab. In general, the standard fire test method NFPA 285 provides a standardized fire test procedure for evaluating the suitability of exterior, non-load bearing wall assemblies and panels used as components of curtain wall assemblies, and that are constructed using combustible materials or that incorporate combustible components for installation on buildings where the exterior walls have to pass the NFPA 285 test.

In order to obtain certified materials, systems and assemblies used for structural fire-resistance and separation of adjacent spaces to safeguard against the spread of fire and smoke within a building and the spread of fire to or from the building, the International Building Code IBC 2012 provides minimum requirements to safeguard the public health, safety and general welfare of the occupants of new and existing buildings and structures. According to the International Building Code IBC 2012 Section 715.4, voids created at the intersection of the exterior curtain wall assemblies and such floor assemblies shall be sealed with an approved system to prevent the interior spread of fire where fire-resistance-rated floor or floor/ceiling assemblies are required. Such systems shall be securely installed and tested in accordance with ASTM E 2307 to provide an F-rating for a time period at least equal to the fire-resistance-rating of the floor assembly.

However, there is a code exception that states that voids created at the intersection of the exterior curtain wall assemblies and such floor assemblies, where the vision glass extends to the finished floor level, shall be permitted to be sealed with an approved material to prevent interior spread of fire. Such material shall be securely installed and capable of preventing the passage of flame and hot gasses sufficient to ignite cotton waste when subjected to ASTM E 119 time-temperature fire conditions under a minimum positive pressure differential of 0.01 inch of water column for the time period at least equal to the fire-resistance-rating of the floor assembly.

Although some glass and frame technologies have been developed that are capable of passing applicable fire test and building code requirements, there is hardly any system that addresses the exception stated in the International Building Code IBC 2012 Section 715.4 and fulfills the code section ASTM E 2307 full-scale testing.

However, there is no system known that addresses above mentioned exception and at the same time complies with the requirements according to ASTM Designation: E 1399-2013, in particular having a movement classification of class IV. Class IV is a combination of thermal, wind, sway and seismic movement types. These have been tested according to the invention in both horizontal and vertical conditions. The E 1399, Standard Test Method for Cyclic Movement and Measuring the Minimum and Maximum Joint Widths of Architectural Joint Systems, is used for simulation of movements of the ground, such as for example an earthquake, or even movements under high wind load or life load. In particular, there is no system known that is used in a curtain wall structure that provides a dynamic system complying with ASTM E 1399, such as for example a curtain wall structure defined by an interior wall surface, which includes an interior panel, such as a back pan, extending over the interior surface thereof and at least one floor spatially disposed from the inner wall surface, thereby sealing of the safing slot between the floor and the back pan of this curtain wall, which extends between the interior wall surface of the interior panel and the outer edge of the floor, in particular when vision glass is employed. Said safing slot is needed to compensate dimensional tolerances of the concreted floor and to allow movement between the floor and the façade element caused by load, such by life, seismic or wind load.

Due to the increasingly strict requirements regarding fire-resistance as well as horizontal and vertical movement, there is a need for a dynamic, thermally and acoustically insulating and sealing system for a curtain wall structure that is capable of meeting or exceeding existing fire test and building code requirements and standards including existing exceptions. In particular, there is a need for systems that prevent the spread of fire when vision glass of a curtain wall structure extends to the finished floor level below even when exposed to certain movements (complying with the requirements for a class IV movement). Further, there is a need for systems that address the architectural limitation of the width of a column or spandrel beam or shear wall behind the curtain wall. Additionally, maintaining safing insulation between the floors of a residential or commercial building and the exterior curtain wall responsive to various conditions including fire, wind and earthquake exposure should be guaranteed.

Further, there is a need for systems that can be easily installed within a safing slot, where, for example, access is only needed from one side, implementing a one-sided application. Further, there is a need for systems that are not limited to the width of a joint of a curtain wall structure thereby compensating at the same time dimensional tolerances of the concreted floor and allowing movement between the floor and the façade element caused by load, temperature or wind load. Moreover, there is a need for systems that improve fire-resistance as well as sound-resistance and can be easily integrated during installation of the curtain wall structure.

Still further there is a need for systems, that can be installed into a unitized panel, making it easier for the installers to the install the pre-assembled curtain wall panel on the jobsite.

In view of the above, it is an object of the present invention to provide a dynamic, thermally insulating and sealing system for effectively thermally insulating and sealing of a safing slot within a building construction, having a curtain wall construction defined by an interior wall surface including one or more framing members and at least one floor spatially disposed from the interior wall surface of the curtain wall construction, wherein the vision glass of a curtain wall structure extends to the finished floor level below.

Still further, it is an object of the present invention to provide a full-scale ASTM E 2307 as well as ASTM E 1399 tested system for floor assemblies where the vision glass extends to the finished floor level, to address the code exception, to avoid letters and engineering judgments, and to secure and provide defined/tested architectural detail for this application, in particular, by providing a tested system for fire—as well as movement-safe architectural compartmentation.

Still further, it is an object of the present invention to provide a tested system that utilizes no aluminum or faced curtain wall insulation, and the safing insulation can be pre-installed from one side, which maintains the safing insulation between the floors of a residential or commercial building and the glass curtain wall responsive to various conditions, including fire exposure, and maximizes safing insulation at a minimal cost.

Still further, it is an object of the present invention to provide a building construction comprising of such a dynamic, thermally insulating and sealing system for effectively thermally insulating and sealing of the safing slot between a glass curtain wall structure and the edge of a floor, in particular within the zero spandrel area, wherein the vision glass of a curtain wall structure extends to the finished floor level below.

Still further, it is an object of the present invention to provide a system that can be easily installed within a safing slot, where, for example, access is only needed from one side, implementing a one-sided application.

Still further, it is an object of the present invention to provide a system, that can be installed into a unitized panel, making it easier for the installers to build up the curtain wall on the jobsite.

Still further, it is an object of the present invention to provide at the same time an acoustic insulating and sealing system for effectively acoustically insulating and sealing of the safing slot between a curtain wall structure and the edge of a floor.

These and other objectives as they will become apparent from the ensuing description of the invention are solved by the present invention as described in various embodiments. Preferred embodiments further describe the invention.

SUMMARY OF THE INVENTION

In one aspect, the present invention provides a dynamic, thermally insulating and sealing system for effectively thermally insulating and sealing of a safing slot within a building construction having a curtain wall construction defined by an interior wall surface including at least one vertical and at least one horizontal framing member and at least one floor spatially disposed from the interior wall surface of the curtain wall construction defining the safing slot extending between the interior wall surface of the curtain wall construction and an outer edge of the floor, comprising a first element comprised of a non-combustible material for receiving a thermally resistant material for insulating, wherein the first element has a cavity-shaped profile, wherein the first element comprises a web section having opposing edges and an inner and an outer surface, a pair of outwardly extending side sections connected to the web section, wherein each side section has an outer and an inner surface, a proximal end and a distal end, wherein the proximal end of each side section is connected to one of the opposing edges of the web section, and wherein the side sections are substantially parallel and confront each other, and at least one supplemental element for attaching of the first element with respect to a bottom side of the horizontal framing member of the curtain wall construction; a second element comprised of a thermally resistant material for insulating positioned in the first element, wherein the second element includes an outer primary end surface positionable in abutment with respect to the inner surface of the web section of the first element, an inner primary end surface positionable spatially disposed from the outer edge of the floor for sealing thereadjacent, and a lower primary and an upper primary surface extending between the proximal and distal ends of the pair of the outwardly extending sidewalls of the first element and in abutment with respect to the inner surface of each of the outwardly extending side sections; a third element comprised of a thermally resistant material for insulating positioned in the safing slot, wherein the third element includes an inner primary end surface positionable in abutment with respect to the outer edge of the floor for sealing thereadjacent; an outer primary end surface positionable in abutment with respect to the inner primary end surface of the second element and spatially disposed from the inner surface of the web section of the first element; and a lower primary and an upper primary surface extending between the distal end of each of the outwardly extending sidewalls of the first element and the outer edge of the floor, and a fourth element for supporting and attaching the first element with respect to an inner facing side of the vertical framing member of the curtain well construction, wherein the first and fourth element form a 5-sided box pan.

In another aspect, the present invention provides a building construction comprising said thermally insulating and sealing system.

In yet another aspect, the present invention provides a dynamic, thermally insulating and sealing system, wherein parts of it are used as a pre-fabricated device for use within a unitized panel construction.

In yet another aspect, the present invention provides a dynamic, thermally insulating and sealing system which is suitable for acoustically insulating and sealing of a safing slot of a curtain wall structure.

BRIEF DESCRIPTION OF THE FIGURES

The subject matter of the present invention is further described in more detail by reference to the following figures.

DETAILED DESCRIPTION OF THE INVENTION

Figure 1:
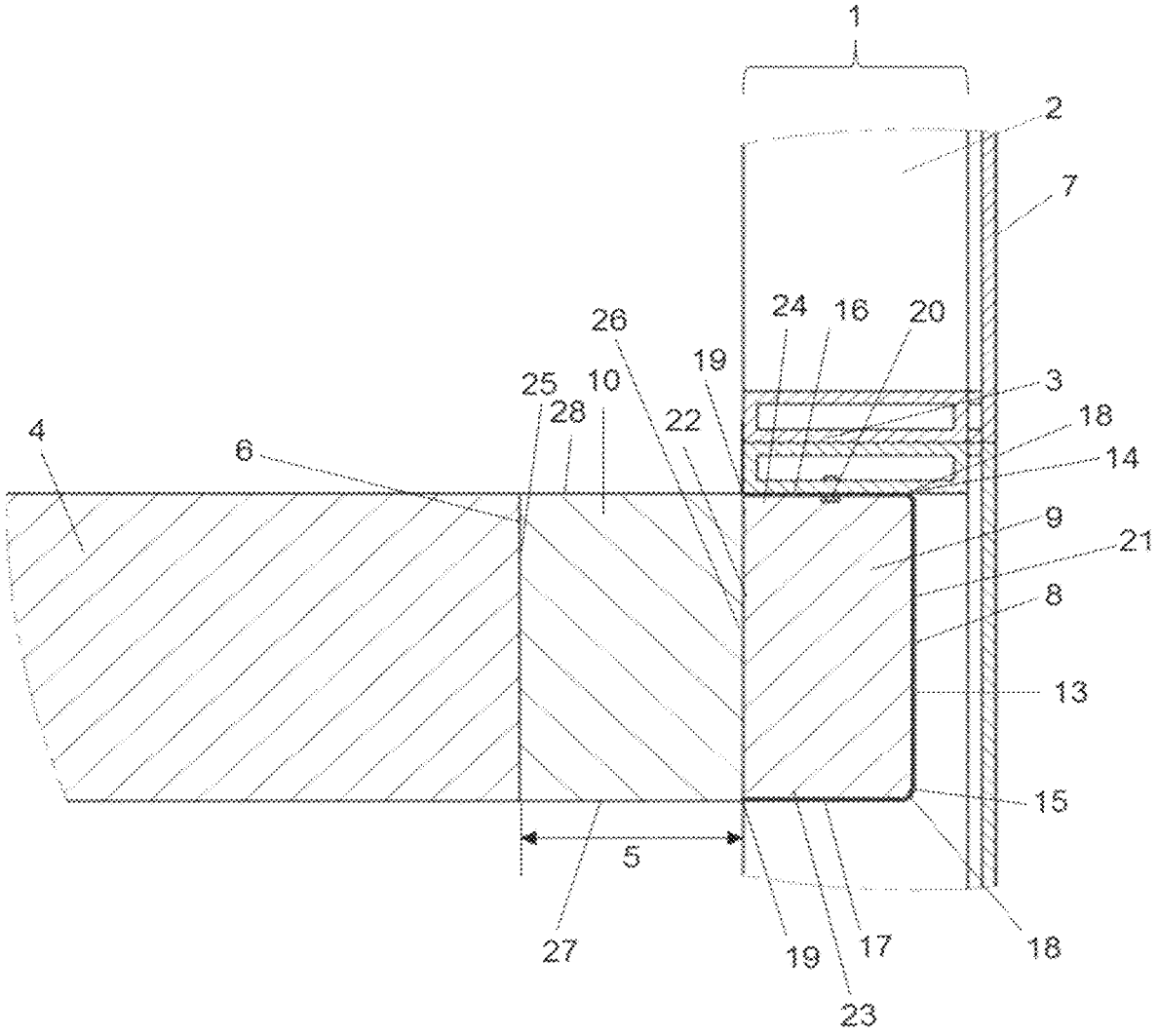
FIG. 1 shows a side cross-sectional view of an embodiment of the dynamic, thermally insulating and sealing system between the outer edge of a floor and the interior wall surface when initially installed and attached to a horizontal framing member (transom at floor level, i.e. zero spandrel) in a curtain wall construction, wherein the vision glass extends to the finished floor level below.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" in context with the present invention refers to a wall structure defined by an interior wall surface including one or more framing members and at least one floor spatially disposed from the interior wall surface of the curtain wall construction. In particular, this refers to a glass curtain wall construction or glass curtain wall structure defined by an interior wall glass surface including one or more extruded framing members, preferably made of aluminum, and at least one floor spatially disposed from the interior wall glass surface.

The term "safing slot" in context with the present invention refers to the gap between a floor and the interior wall surface of the curtain wall construction as defined above; it is also referred to as "perimeter slab edge", extending between the interior wall surface of the curtain wall construction, i.e., vision glass and framing member, and the outer edge of the floor.

The term "zero spandrel" in context with the present invention refers to a horizontal framing member, also called transom, which is located at floor level, i.e., bottom of the transom at the level as top of the floor, preferably concrete floor.

The term "interior wall surface" in context with the present invention refers to the inner facing surface of the curtain wall construction as defined above, in particular, to the inner facing surface of the infilled vision glass and the inner facing surface of the framing members.

The term "cavity-shaped profile" in context with the present invention refers to any shaped profile that is capable of receiving a thermally resistant material for insulating. In particular, the cavity-shaped profile refers to a U-shaped profile, a trapezoidal-shaped profile, a triangular-shaped profile, rectangular-shaped profile, octagonal-shaped profile, preferably to a U-shaped cavity. These profiles can be formed from one or more components.

A glass curtain wall construction or glass curtain wall structure is defined by an interior wall glass surface including one or more framing members and at least one floor spatially disposed from the interior wall surface. Such curtain wall systems commonly include vertical framing members comprising boxed aluminum channels referred to as mullions and similarly configured horizontally extending pieces referred to as transoms. Such a transom located or transom configuration at floor level is also known as zero spandrel, i.e., bottom of the transom at the level as top of the concrete floor. Such glass curtain wall constructions lie within the code exception that the safing slot shall be permitted to be sealed with an approved material to prevent interior spread of fire.

However, it has been surprisingly found out that there the dynamic, thermally insulating and sealing system according to the present invention provides for a system that addresses the code exception and meets the requirements of standard method ASTM E 2307, Standard Test Method for Determining Fire Resistance of Perimeter Fire Barriers Using Intermediate-Scale, Multi-story Apparatus, 2015 as well as complies with the requirements of standard method ASTM E 1399-2013, Standard Test Method for Cyclic Movement and Measuring the Minimum and Maximum Joint Widths of Architectural Joint Systems, addressing the horizontal as well as vertical movements resulting in a movement classification of class IV.

The dynamic, thermally insulating and sealing system according to the present invention is comprised of different elements which provide in accordance with each other for a system that addresses the code exception and meets the requirements of standard method ASTM E 2307 and complies with the requirements of standard method ASTM E 1399, and is described in the following:

According to the present invention the dynamic, thermally insulating and sealing system for effectively thermally insulating and sealing of a safing slot within a building construction having a curtain wall construction defined by an interior wall surface including at least one vertical and at least one horizontal framing member and at least one floor spatially disposed from the interior wall surface of the curtain wall construction defining the safing slot extending between the interior wall surface of the curtain wall construction and an outer edge of the floor, comprises:

i) a first element comprised of a non-combustible material for receiving a thermally resistant material for insulating, wherein the first element has a cavity-shaped profile, comprising:
   a) a web section having opposing edges and an inner and an outer surface;
   b) a pair of outwardly extending side sections connected to the web section, wherein each side section has an outer and an inner surface, a proximal end and a distal end, wherein the proximal end of each side section is connected to one of the opposing edges of the web section, and wherein the side sections are substantially parallel and confront each other; and
   c) at least one supplemental element for attaching of the first element with respect to a bottom side of the horizontal framing member of the curtain wall construction, ii) a second element comprised of a thermally resistant material for insulating positioned in the first element, wherein the second element includes:
   a) an outer primary end surface positionable in abutment with respect to the inner surface of the web section of the first element;
   b) an inner primary end surface positionable spatially disposed from the outer edge of the floor for sealing thereadjacent; and
   c) a lower primary and an upper primary surface extending between the proximal and distal ends of the pair of the outwardly extending sidewalls of the first element and in abutment with respect to the inner surface of each of the outwardly extending side sections, iii) a third element comprised of a thermally resistant material for insulating positioned in the safing slot, wherein the third element includes:
   a) an inner primary end surface positionable in abutment with respect to the outer edge of the floor for sealing thereadjacent;
   b) an outer primary end surface positionable in abutment with respect to the inner primary end surface of the second element and spatially disposed from the inner surface of the web section of the first element; and
   c) a lower primary and an upper primary surface extending between the distal end of each of the outwardly extending sidewalls of the first element and the outer edge of the floor, and iv) a fourth element for supporting and attaching the first element with respect to an inner facing side of the vertical framing member of the curtain wall construction, wherein the first and fourth element form a 5-sided box pan.

In particular, the first element according to the present invention is for use in a fire-resistance rated and movement-rated curtain wall construction, wherein the curtain wall construction is comprised of a vision glass infill and at least one vertical and at least one horizontal metal framing member. The first element of the present invention is considered for the purpose of facilitating fire stopping by receiving and encasing a thermally resistant material positioned in a safing slot present in those buildings utilizing glass curtain wall structures, wherein the vision glass extends to the finished floor level, i.e., in the zero spandrel area of a glass curtain wall construction including only vision glass.

The first element is comprised of a non-combustible material for receiving a thermally resistant material for insulating, and has a cavity-shaped profile. Said cavity-shaped profile comprises a web section having opposing edges and an inner and an outer surface; a pair of outwardly extending side sections connected to the web section, wherein each side section has an outer and an inner surface, a proximal end and a distal end, wherein the proximal end of each side section is connected to one of the opposing edges of the web section, and wherein the side sections are substantially parallel and confront each other; and at least one supplemental element for attaching of the first element with respect to a bottom side of the horizontal framing member of the curtain wall construction.

It is preferred that the first element is comprised of non-combustible material, preferably a metal material, most preferably steel. In a most preferred embodiment, the first element is made of a 12 or 18 gauge galvanized steel material or aluminum, such as an extruded aluminum. However, it is also possible that the first element is comprised of a composite material or a material which is fiber-reinforced.

In preferred embodiment, the first element consists of a first L-shaped member and a second L-shaped member connected to each other to form the cavity-shaped profile. In particular, the first L-shaped member has a first leg and a second leg perpendicular to each other, and the second L-shaped member has a first leg and a second leg perpendicular to each other, wherein the first leg of the second L-shaped member is connected to the second leg of the first L-shaped member, thereby forming a substantially U-shaped profile. The connection of the two L-shaped members maybe via one or more screws, pins, bolts, anchors and the like. In a most preferred embodiment, a first leg of the first L-shaped member has a length of about 3 inch and a second leg of the first L-shaped member has a length of about 6 inch, and a first leg of the second L-shaped member has a length of about 1 inch and a second leg of the second L-shaped member has a length of about 3 inch. However, it is also possible to form the cavity-shaped profile using one or more pieces which are bend or somehow fastened together to form the various profiles, such as a trapezoidal-shaped profile, a triangular-shaped profile, rectangular-shaped profile, or octagonal-shaped profile for receiving a thermally resistant material for insulating.

However, the first element can be designed using various number of pieces. It can be constructed using a single piece but the cost will increase due to the complexity and number of required bends. The web section may also be designed as a one or single piece being planar or having slight bends, such as to form the base of an octagon.

The preferred embodiment of the first element consisting of a first L-shaped member and a second L-shaped member connected to each other makes it easier for the installation of the first element. The first L-shaped member can be installed and fastened to the horizontal framing member. Once the first member is installed, the second L-shaped member will be installed and fastened, optionally also to the fourth member with respect to the vertical framing member. The different length L-shaped members provide an easy access for fastening for the installer making it a one-sided application from the top.

The at least one supplemental element of the first element for attaching of the first element with respect to a bottom side of the horizontal framing member of the curtain wall construction is preferably selected from the group consisting of pins, expansion anchors, screws, screw anchors, bolts and adhesion anchors. Attachment of the first element with respect to the horizontal framing member of the curtain wall construction can alternatively also be performed by attaching it via an additional ledge section or bend section to the front side of the horizontal framing member. Preferably the at least one supplemental element is a No. 10 self-drilling sheet metal screw, most preferably a #10 hex-head self-drilling self-tapping sheet metal screw.

It is preferred that the at least one supplemental element of the first element for attaching extends through the upper outwardly extending side section of the first element and is attached to the bottom of the horizontal framing member of the curtain wall construction.

However, any other suitable attachment region may be chosen as long as maintenance of complete sealing of the safing slot is guaranteed.

In a most preferred embodiment, the pair of outwardly extending side sections of the first element have a length of about 3 inch from the proximal end to the distal, and/or the web section of the first element has a length of about 6 inch from one of its opposing edges to the other one of its opposing edges.

According to the invention is the outer surface of the web section of the first element positioned spatially disposed from the interior wall surface of the curtain wall construction, preferably spatially disposed from the inner surface of the vision glass infill.

Dimensions, material and geometric design of the first element may be varied and adapted to address joint width and transom location in a degree known to a person skilled in the art.

The second element of the dynamic, thermally insulating and sealing system according to the present invention is comprised of a thermally resistant material for insulating positioned in the first element. The second element includes an outer primary end surface positionable in abutment with respect to the inner surface of the web section of the first element; an inner primary end surface positionable spatially disposed from the outer edge of the floor for sealing there-adjacent; and a lower primary and an upper primary surface extending between the proximal and distal ends of the pair of the outwardly extending sidewalls of the first element and in abutment with respect to the inner surface of each of the outwardly extending side sections.

It is preferred that the second element comprises a thermally resistant material for insulating positioned in the first element and spatially disposed from the edge of the floor, preferably a thermally resistant flexible material such as a mineral wool material, to facilitate placement thereof into the safing slot adjacent one another.

In a most preferred embodiment, the thermally resistant flexible mineral wool of the second element is a mineral wool bat insulation having a 3 inch thickness, 8-pcf density, installed with no compression.

The third element of the dynamic, thermally insulating and sealing system according to the present invention is comprised of a thermally resistant material for insulating positioned in the safing slot. The third element includes an inner primary end surface positionable in abutment with respect to the outer edge of the floor for sealing thereadjacent; an outer primary end surface positionable in abutment with respect to the inner primary end surface of the second element and spatially disposed from the inner surface of the web section of the first element; and a lower primary and an upper primary surface extending between the distal end of each of the outwardly extending sidewalls of the first element and the outer edge of the floor.

It is preferred that the third element comprises a thermally resistant material for insulating positioned in the safing slot, preferably a thermally resistant flexible material such as a mineral wool material, to facilitate placement thereof into the safing slot adjacent to the second element.

In a most preferred embodiment, the thermally resistant flexible mineral wool of the third element is a flexible mineral wool material installed with fibers running parallel to the outer edge of the floor. Moreover, it is preferred that a min. 4 inch thick, 4-pcf density, mineral wool bat insulation is employed in the system of the present invention and most preferably installed with 25% compression.

According to the present invention, the second element and the third element each comprise a thermally resistant flexible mineral wool material to facilitate placement thereof into the safing slot and the cavity-shaped profile of the first element adjacent one another. The second and third element facilitate maintaining of abutment within the first element and the safing slot, and hence are independent responsive to thermal deforming of the interior wall surface.

According to the present invention, the dynamic, thermally insulating and sealing system may further comprise a fourth element for supporting and attaching the first element with respect to an inner facing side of the vertical framing member of the curtain wall construction, wherein the fourth element has a substantially L-shaped profile and includes elements for attachment. The first and fourth element form a 5-sided box pan.

The fourth element is preferably positioned underneath one of the outwardly extending side sections of the first element thereby closing the gap between the outwardly extending side sections of the first element and the vertical framing member due to the architectural structure of the glass curtain wall assembly.

It is preferred that the fourth element of the dynamic, thermally insulating and sealing system is comprised of a non-combustible material, preferably a metal material, most preferably steel. In a particular preferred embodiment of the present invention, the fourth element is an angle bracket made from a 12 or 18 gauge galvanized steel material or aluminum, such as an extruded aluminum. In a most preferred embodiment, a first leg of the angle bracket has a length of about 3 inch and a second leg of the angle bracket has a length of about 1 inch. Dimensions and geometric design of the fourth element may be varied and adapted to address joint width and mullion location in a degree known to a person skilled in the art.

In a preferred embodiment of the present invention, the fourth element has attachment regions for facilitating attachment with respect to the vertical framing member and the first element within the spandrel area of the curtain wall construction. Preferably, the fourth element of the dynamic, thermally insulating and sealing system, comprises elements for attachment, as defined above, extending through the fourth element and are attached to the inner side of the vertical framing member. However, any other suitable attachment region may be chosen as long as maintenance of complete sealing of the safing slot is guaranteed.

According to the present invention, the dynamic, thermally insulating and sealing system may further comprise an additional element comprised of a thermally resistant material for insulating positioned in the safing slot in abutment with respect to the vertical framing member, i.e. located in front of the vertical framing member.

It is preferred that the thermally resistant material for insulating of the additional element, is a thermally resistant flexible material such as a mineral wool material, to facilitate placement thereof into the safing slot and in front of the vertical framing member.

In a particular preferred embodiment of the present invention, the additional element is integrally connected to the third element and made of a thermally resistant flexible mineral wool material installed with fibers running parallel to the outer edge of the floor. Moreover, it is preferred that a 12 inch long, 4-pcf density, mineral wool bat insulation is centered at the vertical framing member, i.e., mullion, and installed with 25% compression and depth to overcome the slab thickness. This installation is also referred to as the integrated mullion cover.

In a particular preferred embodiment of the present invention, the thermally resistant flexible mineral wool material of the third element is installed continuously and in abutment with respect to the outer edge of the floor, the second element, and the interior facing surface of the vertical framing member.

It is preferred that the upper as well as the lower primary surfaces of the second and third element of the dynamic, thermally insulating and sealing system according to the present invention are flush with respect to the upper and lower side of the floor, and the pair of outwardly extending side sections, respectively.

According to the present invention, the dynamic, thermally insulating and sealing system may further comprise an outer fire retardant coating positioned across the third element and the adjacent portions of the at least one vertical and at least one horizontal framing member of the curtain wall construction and the floor located thereadjacent. The sealing characteristics of the construction shown in the present invention are significantly enhanced by the application of such fire retardant coating.

Generally, such fire retardant coatings are applied by spraying or other similar means of application. Such fire retardant coatings, in particular outer fire retardant coatings, are for example firestop joint sprays, preferably based on water, and self-leveling silicone sealants. For example, Hilti Firestop Joint Spray CFS-SP WB can be used as an outer fire retardant coating in accordance with the present invention. In one preferred embodiment of the present invention the outer fire retardant coating is a water-based or silicone-based outer fire retardant coating, preferably a firestop joint spray. The outer fire retardant coating that can be applied in the system of the present invention is preferably in the form of an emulsion, spray, coating, foam, paint or mastic.

According to one embodiment of the present invention, it is preferred that the outer fire retardant coating has a wet film thickness of at least ⅛ inch. Additionally, it is preferable that the outer fire retardant coating covers the top of the thermally resistant flexible mineral wool material overlapping the outer edge of the floor and the interior face of the at least one vertical and at least one horizontal framing member surface of the curtain wall construction by a min. of ½ inch.

The outer fire retardant material can be applied across the third element and the adjacent areas of the interior wall surface and floor.

According to the present invention, the dynamic, thermally insulating and sealing system may further comprise a silicone sealant, preferably a firestop silicone, in order to restrict air movement and to serve as a vapor barrier. The application of a silicone sealant allows the usage of an unfaced curtain wall insulating material, i.e., mineral wool without any foil or tape around the outside, in particular in cases, where the cavity-shaped profile consists of more the one pieces.

According to the present invention, the dynamic, thermally insulating and sealing system is initially installed within the zero spandrel area of a glass curtain wall construction.

In a first step, the first element is fastened to the horizontal framing member. In a preferred embodiment, a first leg of the first L-shaped member is installed and fastened to the bottom of the horizontal framing member using the elements for attachment, preferably self-drilling screws. Once the first member is installed, the second L-shaped member is installed and fastened, optionally also to the fourth member with respect to the vertical framing member. Preferably, the first leg of the second L-shaped member is connected to the second leg of the first L-shaped member, thereby forming a substantially U-shaped profile. The connection of the two L-shaped members maybe via one or more screws, pins, bolts, anchors and the like. The first element is installed such that the outer surface of the web section of the first element is positioned spatially disposed from the interior wall surface of the curtain wall construction, preferably spatially disposed from the inner surface of the vision glass infill.

In a second step, the second element, preferably 8-pcf density, unfaced mineral wool—also referred to as unfaced curtain wall insulation—, is friction-fitted into the cavity-shaped first element. The outer primary end surface is positioned in abutment with respect to the inner surface of the web section of the first element, the inner primary end surface is positioned spatially disposed from the outer edge of the floor, and the lower primary and the upper primary surface extend between the proximal and distal ends of the pair of the outwardly extending sidewalls of the first element and in abutment with respect to the inner surface of each of the outwardly extending side sections.

In a third step, the third element, preferably mineral wool with 4 inch depth is continuously installed with 25% compression into the safing slot with its inner primary end surface positioned in abutment with respect to the outer edge of the floor and its outer primary end surface positioned in abutment with respect to the inner primary end surface of the second element and spatially disposed from the inner surface of the web section of the first element. The lower primary and the upper primary surface extended between the distal end of each of the outwardly extending sidewalls of the first element and the outer edge of the floor.

In a fourth step, a fire retardant coating is applied across the third element and the adjacent portions of the at least one vertical and at least one horizontal framing member of the curtain wall construction and the floor located thereadjacent. Said fire retardant coating, in particular, the outerfire retardant coating, may be for example a silicone-base fire retardant coating, such as Hilti CFS-SP WB or SIL firestop joint spray having a wet thickness of at least ⅛ inch. The outer fire retardant coating covers the top of the thermally resistant flexible mineral wool material overlapping the outer edge of the floor and the interior face of the at least one vertical and at least one horizontal framing member surface of the curtain wall construction by a min. of ½ inch.

When installing, the insulating elements are compressed to varying degrees, but normally compressed to approximately 25% in comparison to a standard of 33%. This compression will cause exertion of a force outwardly against the other elements of the system in order to expand outwardly to fill voids created in the safing slot.

The dynamic, thermally insulating and sealing system according to the present invention is preferably for use with a building construction defined by an interior wall surface including one or more framing members and at least one floor spatially disposed from the interior wall surface of the curtain wall construction defining the safing slot extending between the interior wall surface of the curtain wall construction and an outer edge of the floor.

In particular, the building construction comprises a dynamic, thermally insulating and sealing system for effectively thermally insulating and sealing of the safing slot, wherein the dynamic, thermally insulating and sealing means comprises:

i) a first element comprised of a non-combustible material for receiving a thermally resistant material for insulating, wherein the first element has a cavity-shaped profile, comprising:
   a) a web section having opposing edges and an inner and an outer surface;
   b) a pair of outwardly extending side sections connected to the web section, wherein each side section has an outer and an inner surface, a proximal end and a distal end, wherein the proximal end of each side section is connected to one of the opposing edges of the web section, and wherein the side sections are substantially parallel and confront each other; and
   c) at least one supplemental element for attaching of the first element with respect to a bottom side of the horizontal framing member of the curtain wall construction, ii) a second element comprised of a thermally resistant material for insulating positioned in the first element, wherein the second element includes:
   a) an outer primary end surface positionable in abutment with respect to the inner surface of the web section of the first element;
   b) an inner primary end surface positionable spatially disposed from the outer edge of the floor for sealing thereadjacent; and
   c) a lower primary and an upper primary surface extending between the proximal and distal ends of the pair of the outwardly extending sidewalls of the first element and in abutment with respect to the inner surface of each of the outwardly extending side sections, iii) a third element comprised of a thermally resistant material for insulating positioned in the safing slot, wherein the third element includes:
   a) an inner primary end surface positionable in abutment with respect to the outer edge of the floor for sealing thereadjacent;
   b) an outer primary end surface positionable in abutment with respect to the inner primary end surface of the second element and spatially disposed from the inner surface of the web section of the first element; and
   c) a lower primary and an upper primary surface extending between the distal end of each of the outwardly extending sidewalls of the first element and the outer edge of the floor, iv) a fourth element for supporting and attaching the first element with respect to an inner facing side of the vertical framing member of the curtain wall construction, wherein the fourth element has a substantially L-shaped profile and includes elements for attachment, wherein the first and fourth element form a 5-sided box pan; and v) an outer fire retardant coating positioned across the first element and the adjacent portions of the interior framing member of the curtain wall construction and the floor located thereadjacent.

It is preferred that the building construction comprises a curtain wall construction that is comprised of a vision glass infill and at least one vertical and at least one horizontal metal framing member.

The dynamic, thermally insulating and sealing system according to the present invention moreover serves as a construction part when building up unitized panels. In particular, the first and the second element are used as a pre-fabricated device for use within a unitized panel construction. The first element is preferably installed during the build-up of the unitized panel. Generally, unitized panels are built from one side of the finished product, usually glass side.

A unitized curtain wall panel production allows the curtain wall manufacturers to install all required curtain wall components off site and then ship the complete unitized panel onsite for an easy quick installation on to the building.

The following steps are completed while the panel is manufactured on a flat horizontal surface. First, the frame of the unitized panel (i.e. mullions, upper transom, lower transom) is built up. In a second step, the first element and optionally the fourth element are installed to the unitized panel with the appropriate fasteners in a similar manner as described above. The glass is installed to the unitized panel and then the panel is flipped over to gain proper access to the first element in order to install the thermally resistant material for insulating. This complete unitized panel with zero spandrel insulation is then delivered and hung at the jobsite. Once the panels are hung and adjusted, the thermally resistant material for insulating (third element) is installed in the curtain wall joint, i.e. safing slot. After the thermally resistant material is properly installed, the outer fire retardant coating is applied to the top surface.

The dynamic, thermally insulating and sealing system of the present invention is also for acoustically insulating and sealing of a safing slot of a curtain wall structure. The material used for insulating may be of a sound resistant and/or airtight material, such as a mineral wool material coated with an acrylic- or silicone-based material, rubber-like material or a foam, such for example an elastomeric interlaced foam based on synthetic rubber (Armaflex), a polyethylene foam, a polyurethane foam, a polypropylene foam or a polyvinyl chloride foam.

While the invention is particularly pointed out and distinctly described herein, a preferred embodiment is set forth in the following detailed description which may be best understood when read in connection with the accompanying drawings.

In FIG. 1 is shown a side cross-sectional view of an embodiment of the dynamic, thermally insulating and sealing system between the outer edge of a floor and the interior wall surface when initially installed and attached to a horizontal framing member (transom at floor level, i.e. zero spandrel) in a curtain wall construction, wherein the vision glass extends to the finished floor level below—glass curtain wall construction. In particular, the dynamic, thermally insulating and sealing system is initially installed within the zero spandrel area of a glass curtain wall construction, defined by an interior wall surface 1 including one or more framing members, i.e., vertical framing member—mullion 2—and horizontal framing member—transom 3—which is located at the floor level, and at least one floor 4 spatially disposed from the interior wall surface 1 of the curtain wall construction defining the safing slot 5 extending between the interior wall surface 1 of the curtain wall construction and an outer edge 6 of the floor 4. The framing members 2 and 3 are infilled with vision glass 7 extending to the finished floor level below. The dynamic, thermally insulating and sealing system of the present invention comprises a first element 8 comprised of a non-combustible material for receiving a thermally resistant material for insulating a second element 9 comprised of a thermally resistant material for insulating positioned in the first element 8, and a third element 10 comprised of a thermally resistant material for insulating positioned in the safing slot. Further, the dynamic, thermally insulating and sealing system of the present invention comprises a fourth element 11 (not shown in FIG. 1) for supporting and attaching the first element with respect to an inner facing side 12 of the vertical framing member 2 of the curtain wall construction. In particular, the first element 8 is comprised of a non-combustible material, such as metal, preferably made from an 18 gauge galvanized steel material, and has a cavity-shaped profile. Depicted in FIG. 1 is substantially U-shaped profile. Said profile comprises a web section 13 having opposing edges 14, 15, and an inner and an outer surface; a pair of outwardly extending side sections 16, 17 connected to the web section 13, wherein each side section 16, 17 has an outer and an inner surface, a proximal end 18 and a distal end 19, wherein the proximal end 18 of each side section 16, 17 is connected to one of the opposing edges 14, 15 of the web section 13, and wherein the side sections 16, 17 are substantially parallel and confront each other and at least one supplemental element 20 for attaching of the first element 8 with respect to a bottom side of the horizontal framing member 3 of the curtain wall construction. The supplemental element 20 is preferably a No. 10 self-drilling sheet metal screw, such as a #10 hex-head self-drilling self-tapping sheet metal screw. The supplemental element 20 of the first element 8 for attaching extends through the upper outwardly extending side section 16 of the first element 8 and is attached to the bottom of the horizontal framing member 3 of the curtain wall construction. The outer surface of the web section 13 of the first element 8 is positioned spatially disposed from the interior wall surface of the curtain wall construction, especially spatially disposed from the inner surface of the vision glass infill 7. The second element 9 is comprised of a thermally resistant material for insulating positioned in the first element 8. The second element 9 includes an outer primary end surface 21 positionable in abutment with respect to the inner surface of the web section 13 of the first element 8; an inner primary end surface 22 positionable spatially disposed from the outer edge 6 of the floor 4 for sealing thereadjacent; and a lower primary 23 and an upper primary surface 24 extending between the proximal 18 and distal ends 19 of the pair of the outwardly extending sidewalls 16, 17 of the first element 8 and in abutment with respect to the inner surface of each of the outwardly extending side sections 16, 17. The thermally resistant material for insulating of the second element 9, is mineral wool, preferably a min. 8-pcf density unfaced curtain wall insulation having a thickness of 3 inch, and installed within the cavity of first element 8. The third element 10 of the dynamic, thermally insulating and sealing system is comprised of a thermally resistant material for insulating positioned in the safing slot. The third element includes an inner primary end surface 25 positionable in abutment with respect to the outer edge 6 of the floor 4 for sealing thereadjacent; an outer primary end surface 26 positionable in abutment with respect to the inner primary end surface 22 of the second element 9 and spatially disposed from the inner surface of the web section 13 of the first element 8; and a lower primary 27 and an upper primary surface 28 extending between the distal end 19 of each of the outwardly extending sidewalls 16, 17 of the first element 8 and the outer edge 6 of the floor 4. The thermally resistant material for insulating of the third element 10, is mineral wool, preferably having a min. 4-pcf density and a thickness of 4 inch. Not shown in FIG. 1 is that the thermally resistant flexible mineral wool material of the third element 10 is installed with fibers running parallel to the outer edge 6 of the floor 4.

Figure 2:
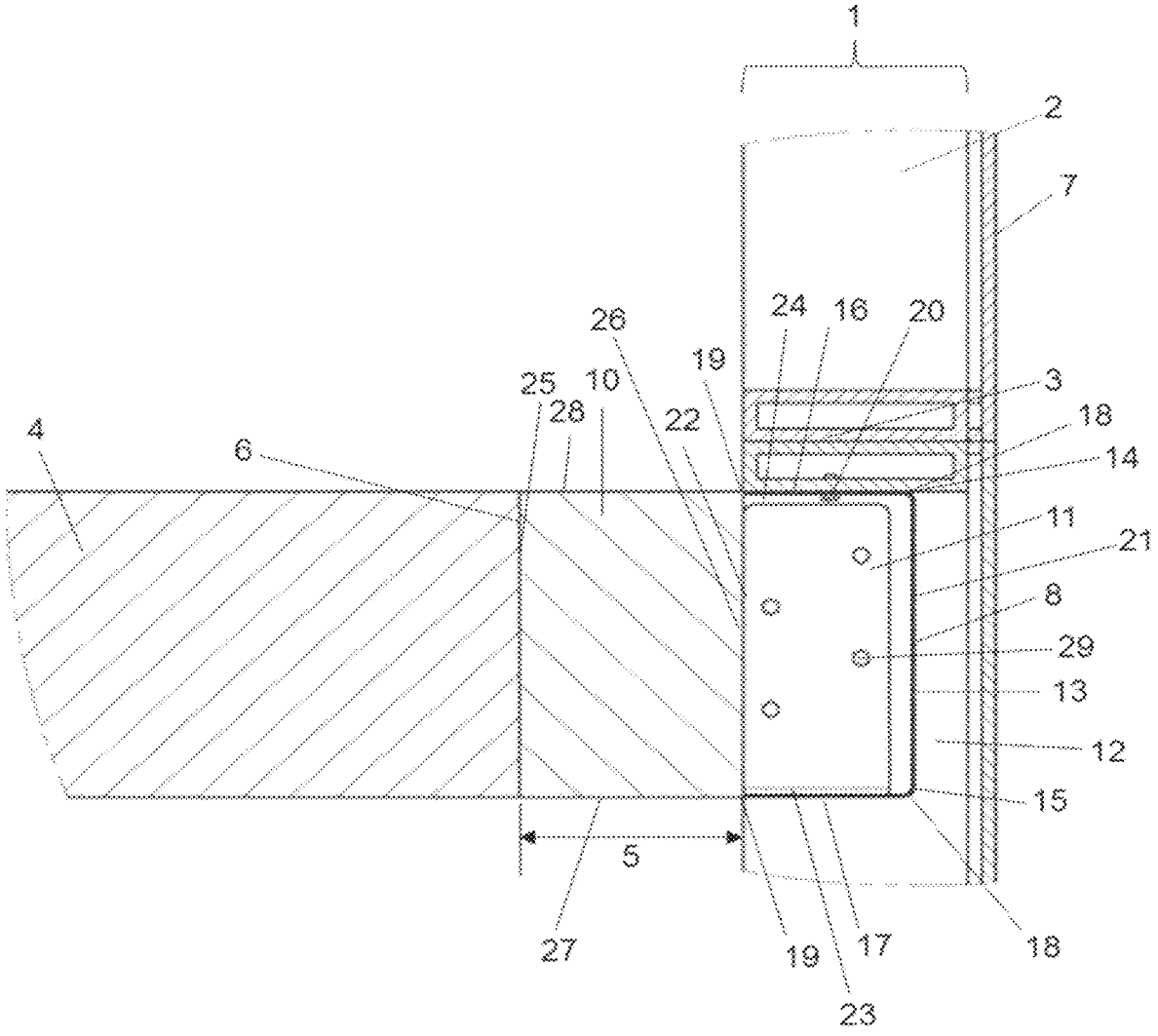
FIG. 2 shows a side cross-sectional view of an embodiment of the dynamic, thermally insulating and sealing system between the outer edge of a floor and the interior wall surface when initially installed and attached additionally to a vertical framing member (mullion) in a curtain wall construction, wherein the vision glass extends to the finished floor level below.

FIG. 2 shows a side cross-sectional view of the embodiment of the dynamic, thermally insulating and sealing system shown in FIG. 1, between the outer edge of a floor and the interior wall surface when initially installed and attached additionally to a vertical framing member (mullion) in a curtain wall construction, wherein the vision glass extends to the finished floor level below. FIG. 2 shows the fourth element 11 supporting and attaching the first element 8 with respect to an inner facing side 12 of the vertical framing member 2 of the curtain wall construction, wherein the fourth element 11 has a substantially L-shaped profile and includes elements for attachment 29. The fourth element 11 is positioned underneath one of the outwardly extending side sections 17 of the first element 8 thereby closing the gap between the outwardly extending side sections 17 of the first element 8 and the vertical framing member 2 due to the architectural structure of the glass curtain wall assembly. The fourth element 11 is comprised of a non-combustible material, preferably a metal material, most preferably steel. As shown in FIG. 2, the fourth element 11 is an angle bracket made from 18 gauge galvanized steel material, preferably a first leg of the angle bracket has a length of about 3 inch and a second leg of the angle bracket has a length of about 1 inch. The elements for attachment 29 are No. 10 self-drilling sheet metal screws, preferably #10 hex-head self-drilling self-tapping sheet metal screws.

Figure 3:
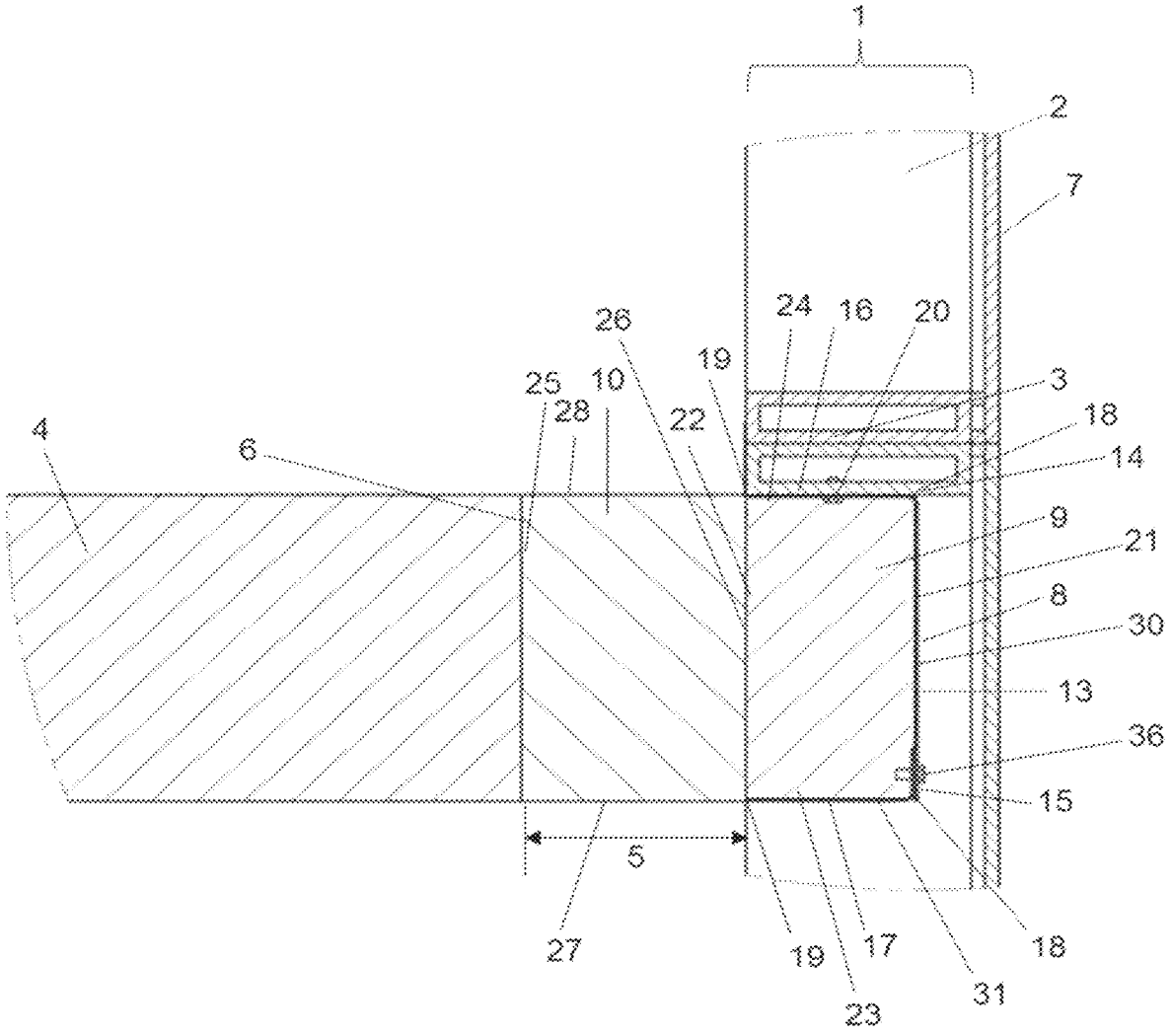
FIG. 3 shows a side cross-sectional view of another embodiment of the dynamic, thermally insulating and sealing system between the outer edge of a floor and the interior wall surface when initially installed and attached to a horizontal framing member (transom at floor level, i.e. zero spandrel) in a curtain wall construction, wherein the vision glass extends to the finished floor level below.
Figure 6:
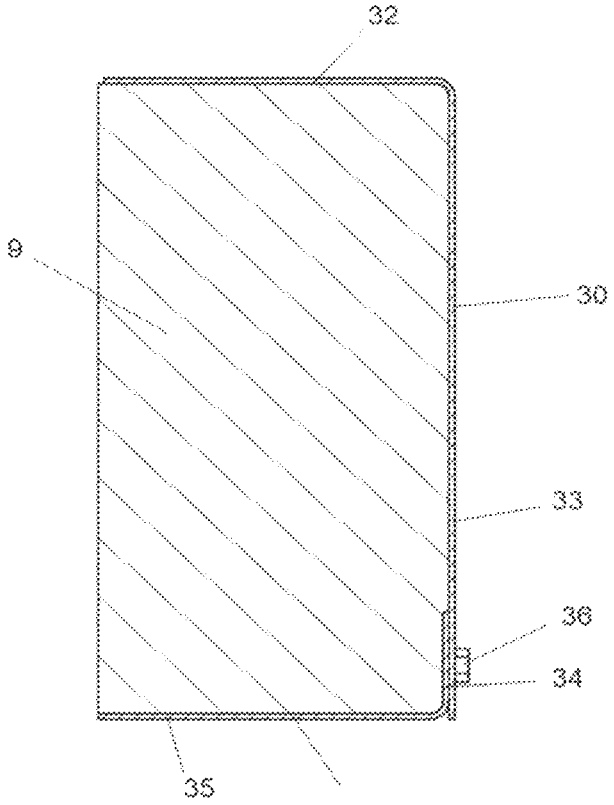
FIG. 6 shows a side cross-sectional view of an embodiment of the first and second element of the dynamic, thermally insulating and sealing system.
Figure 7:
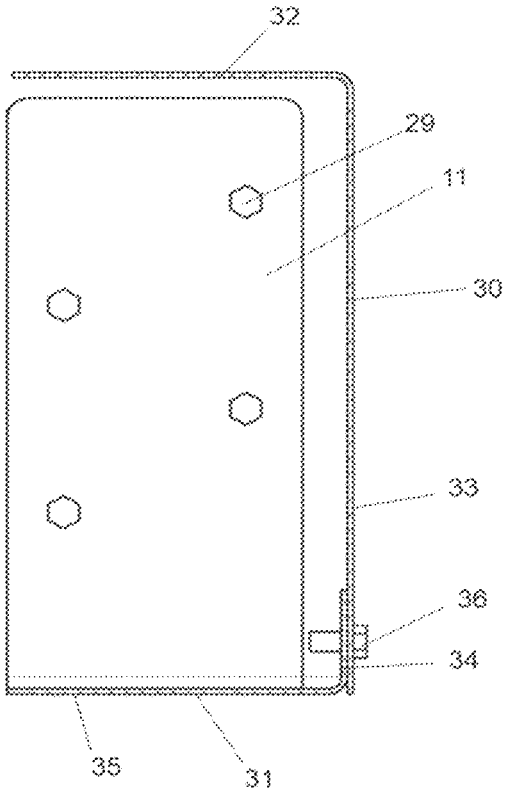
FIG. 7 shows a side cross-sectional view of an embodiment of the first and fourth element of the dynamic, thermally insulating and sealing system.

In FIG. 3 is shown a side cross-sectional view of another embodiment of the dynamic, thermally insulating and sealing system between the outer edge of a floor and the interior wall surface when initially installed and attached to a horizontal framing member (transom at floor level, i.e. zero spandrel) in a curtain wall construction, wherein the vision glass extends to the finished floor level below. The first element 8 consists of a first L-shaped member 30 and a second L-shaped member 31 connected to each other to form the cavity-shaped profile (FIGS. 6 and 7). In particular, the first L-shaped member 30 has a first leg 32 and a second leg 33 perpendicular to each other, and the second L-shaped 31 member has a first leg 34 and a second leg 35 perpendicular to each other, wherein the first leg 34 of the second L-shaped member 31 is connected to the second leg 33 of the first L-shaped member 30, thereby forming a substantially U-shaped profile. The connection of the two L-shaped members 30, 31 occurs via a No. 10 self-drilling sheet metal screw 36, such as a #10 hex-head self-drilling self-tapping sheet metal screw. As depicted, the first leg 32 of the first L-shaped member 30 has a length of about 3 inch and the second leg 33 of the first L-shaped member 30 has a length of about 6 inch, and the first leg 34 of the second L-shaped member 31 has a length of about 1 inch and a second leg 35 of the second L-shaped member 31 has a length of about 3 inch. In particular, the first L-shaped member 30 and a second L-shaped member 31 are comprised of a non-combustible material, such as metal, preferably made from an 18 gauge galvanized steel material. The other remaining elements of the dynamic, thermally insulating and sealing system are the same as described for FIG. 1.

Figure 4:
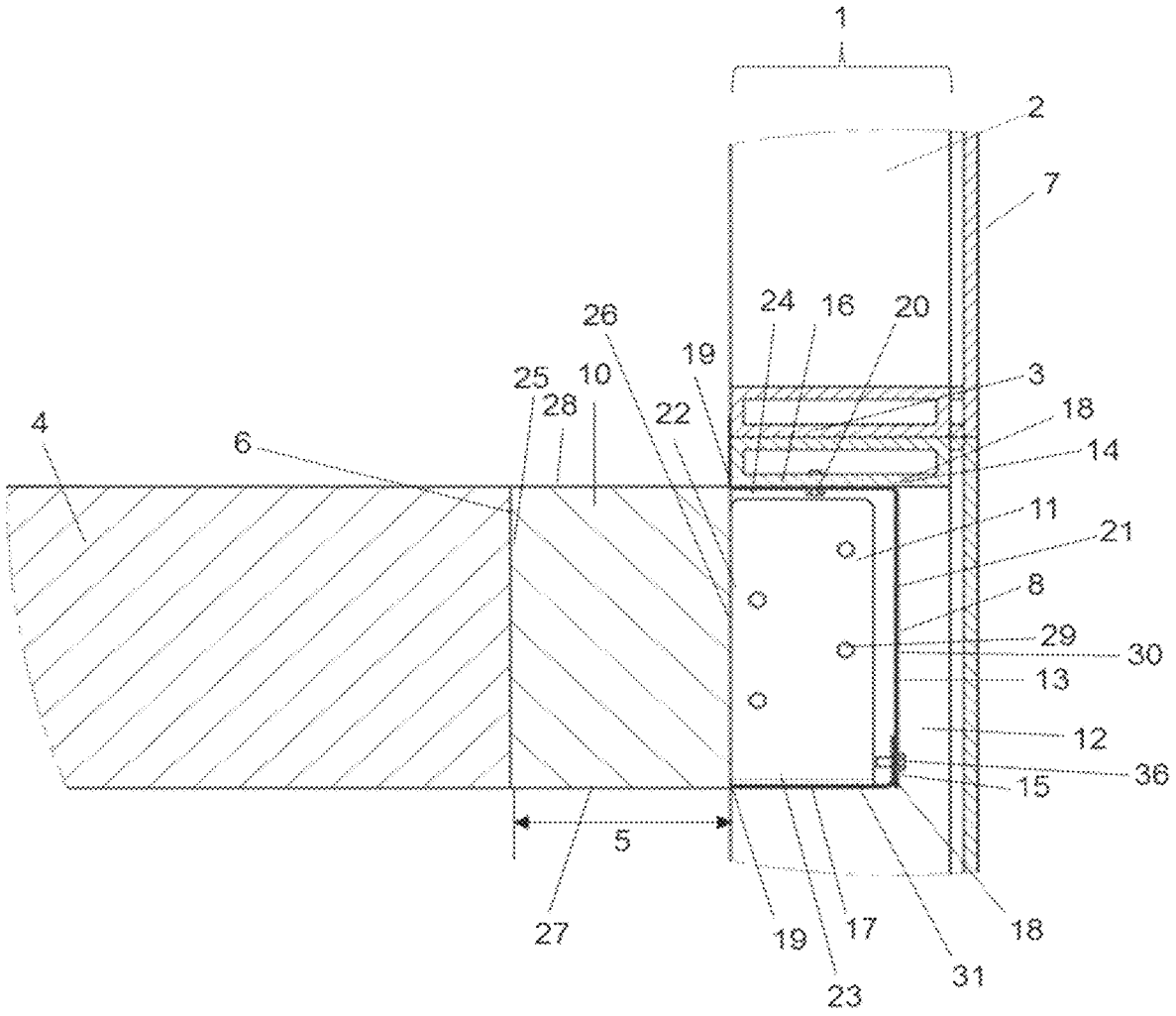
FIG. 4 shows a side cross-sectional view of another embodiment of the dynamic, thermally insulating and sealing system between the outer edge of a floor and the interior wall surface when initially installed and attached additionally to a vertical framing member (mullion) in a curtain wall construction, wherein the vision glass extends to the finished floor level below.

FIG. 4 shows a side cross-sectional view of the embodiment of the dynamic, thermally insulating and sealing system shown in FIG. 3, between the outer edge of a floor and the interior wall surface when initially installed and attached additionally to a vertical framing member (mullion) in a curtain wall construction, wherein the vision glass extends to the finished floor level below. The other remaining elements of the dynamic, thermally insulating and sealing system are the same as described for FIG. 2.

Figure 5A:
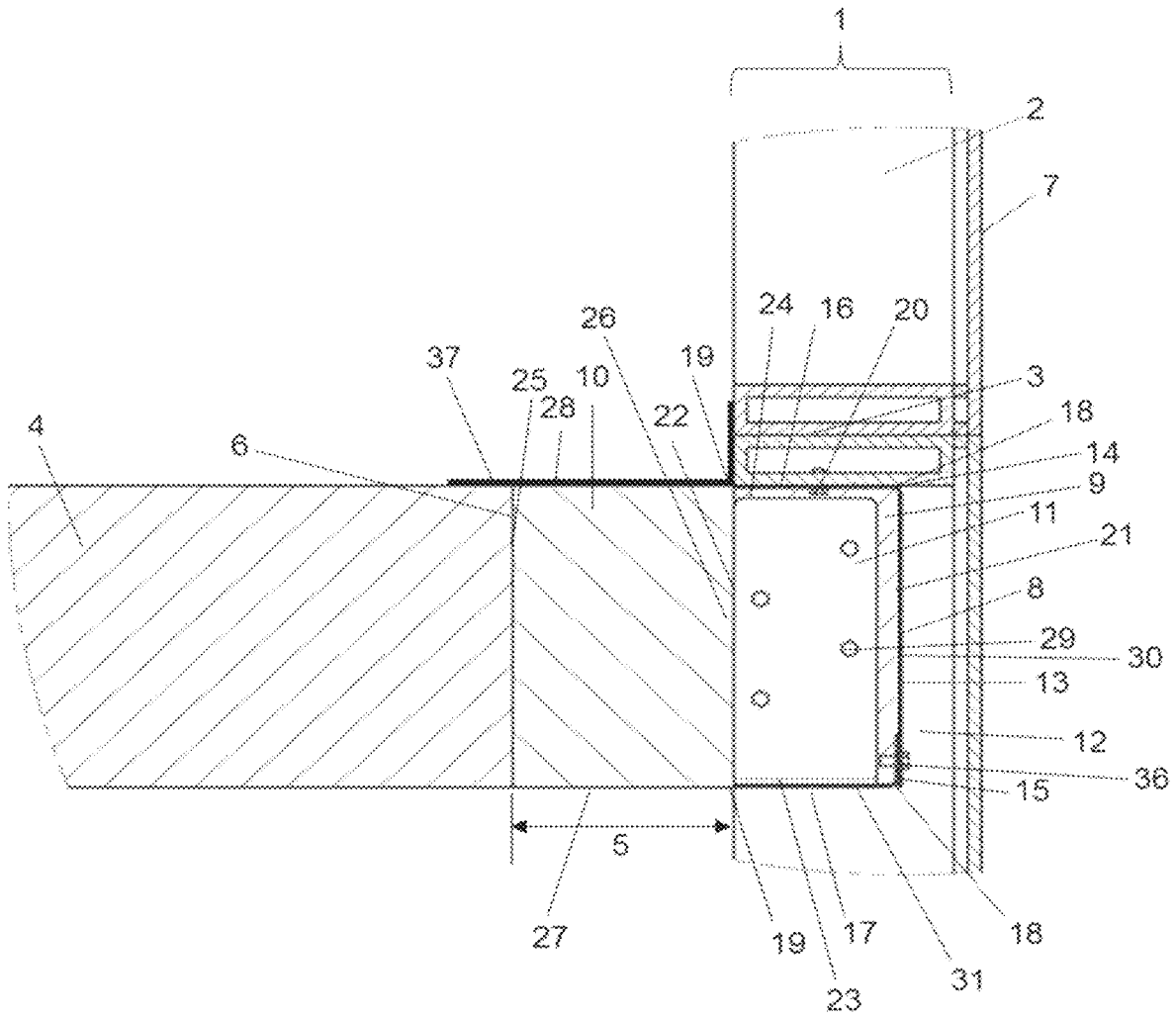
FIG. 5*a* shows a side cross-sectional overall view of another embodiment of the dynamic, thermally insulating and sealing system between the outer edge of a floor and the interior wall surface when initially installed in a curtain wall construction, wherein the vision glass extends to the finished floor level below.

FIG. 5*a* shows a side cross-sectional overall view of the embodiment of the dynamic, thermally insulating and sealing system shown in FIGS. 3 and 4 between the outer edge of a floor and the interior wall surface when initially installed in a curtain wall construction, wherein the vision glass extends to the finished floor level below. In FIG. 5, an outer fire retardant coating 37 is positioned across the third element 10 and the adjacent portions of the at least one vertical 2 and at least one horizontal framing member 3 of the curtain wall construction and the floor 4 located thereadjacent in order to further maintain a complete seal extending within the safing slot 5 in those conditions where the interior wall surface 1 has expanded beyond the lateral expansion capability of the insulating elements. The other remaining elements of the dynamic, thermally insulating and sealing system are the same as described for FIGS. 3 and 4.

Figure 5B:
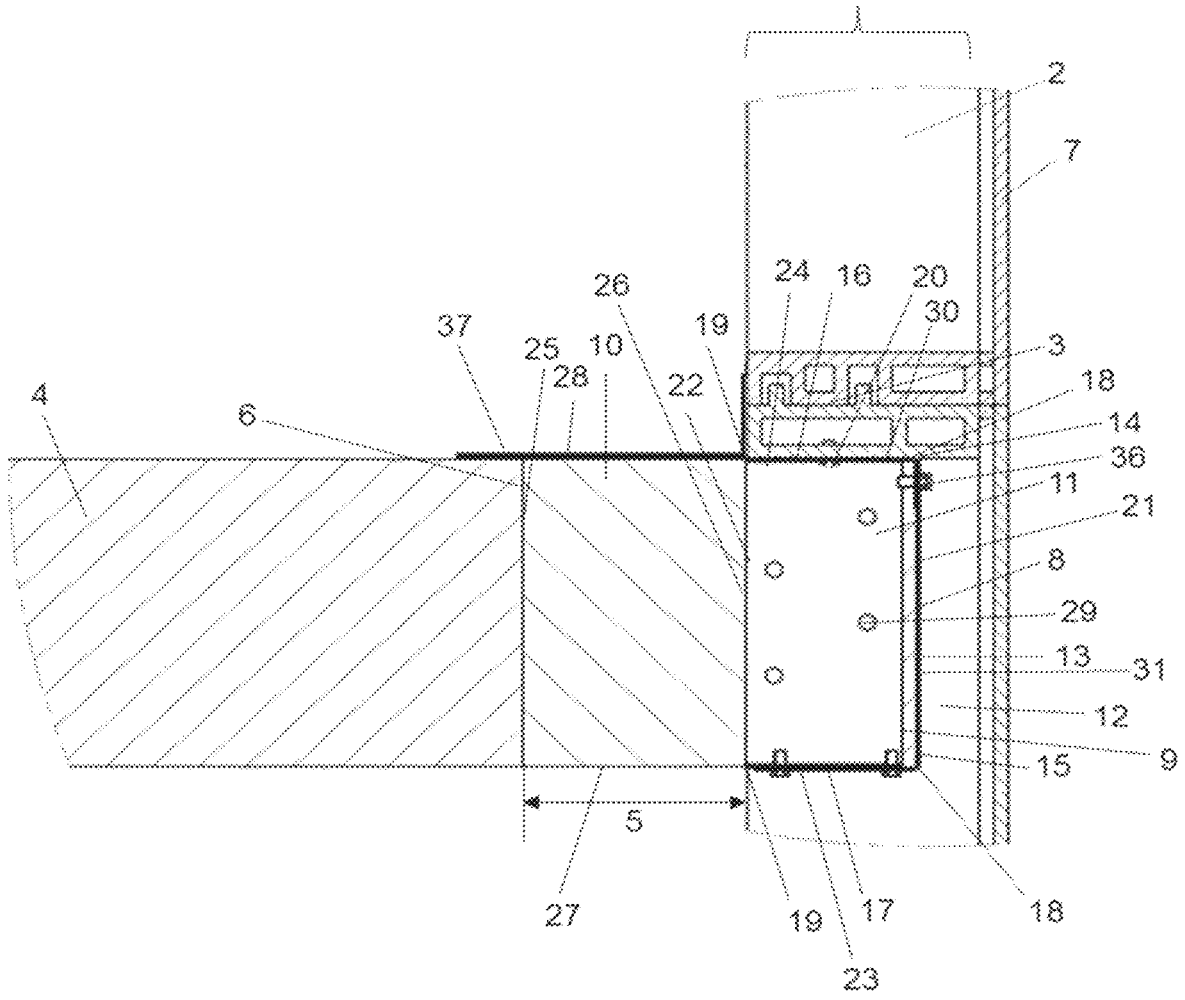
FIG. 5*b* shows a side cross-sectional overall view of another embodiment of the dynamic, thermally insulating and sealing system between the outer edge of a floor and the interior wall surface when initially installed in a curtain wall construction, wherein the vision glass extends to the finished floor level below.

FIG. 5*b* shows a side cross-sectional overall view of another embodiment of the dynamic, thermally insulating and sealing system between the outer edge of a floor and the interior wall surface when initially installed in a curtain wall construction, wherein the vision glass extends to the finished floor level below. The dynamic, thermally insulating and sealing system is installed as a unitized system and the U-shaped cavity has first L-shaped member 30 and a second L-shaped member 31 having different dimensions and fastening points when compared to FIG. 5*a*.

FIG. 6 shows a side cross-sectional view of an embodiment of the first 8 and second element 9 of the dynamic, thermally insulating and sealing system as described for FIG. 3, and FIG. 7 shows a side cross-sectional view of an embodiment of the first 8 and fourth element 11 of the dynamic, thermally insulating and sealing system as described for FIG. 4.

Figure 8:
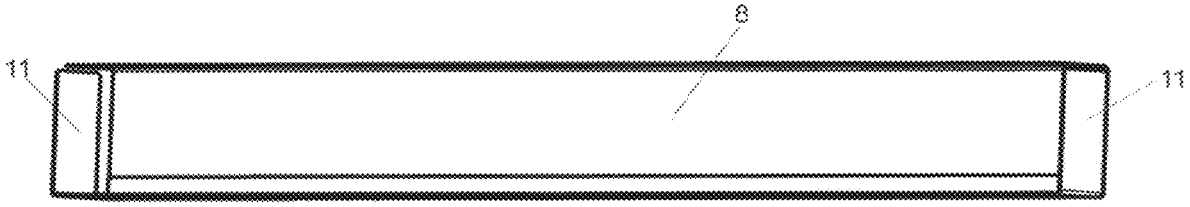
FIG. 8 shows a perspective view of an embodiment of the first and fourth element of the dynamic, thermally insulating and sealing system without mineral wool.
Figure 9:
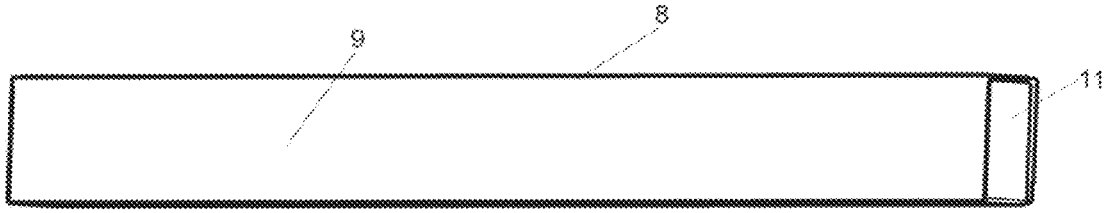
FIG. 9 shows a perspective view of an embodiment of the first and fourth element of the dynamic, thermally insulating and sealing system, filled with mineral wool.

FIG. 8 shows a perspective view of an embodiment of the first 8 and fourth element 11 of the dynamic, thermally insulating and sealing system as described for FIGS. 3 and 4 without mineral wool (second element 9) and FIG. 9 shows a perspective view of an embodiment of the first 8 and fourth element 11 of the dynamic, thermally insulating and sealing system as described for FIGS. 3 and 4 filled with mineral wool (second element 9).

Figure 10:
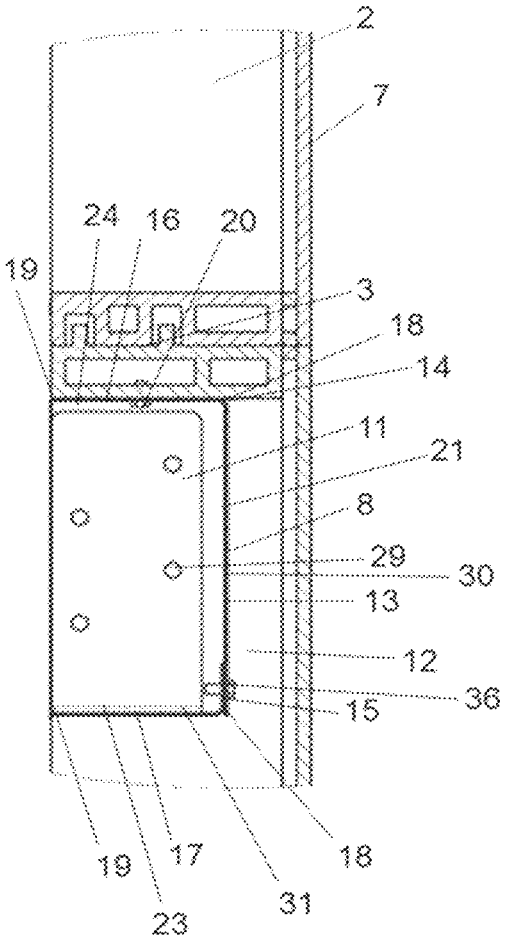
FIG. 10 shows a side cross-sectional view of an embodiment the pre-fabricated device in a unitized panel construction at a horizontal framing member (transom).
Figure 11:
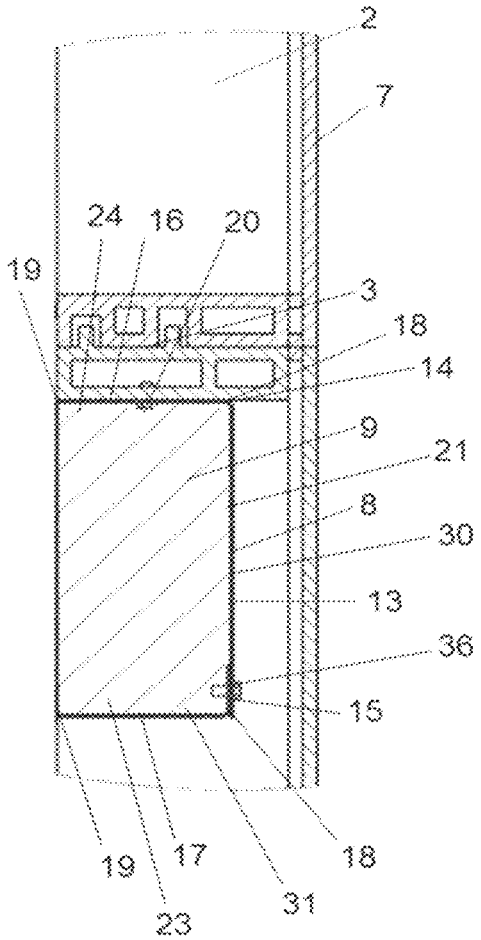
FIG. 11 shows a side cross-sectional view of an embodiment the pre-fabricated device in a unitized panel construction at vertical framing member (mullion).

FIGS. 10 and 11 shows side cross-sectional views of an embodiment the pre-fabricated device in a unitized panel construction. The relevant elements depicted of the dynamic, thermally insulating and sealing system are the same as described for FIGS. 3 and 4. The detailed transom structures clearly depicts the utilization at least parts of the system (first, second and optionally fourth element) within a unitized panel construction.

Figure 12:
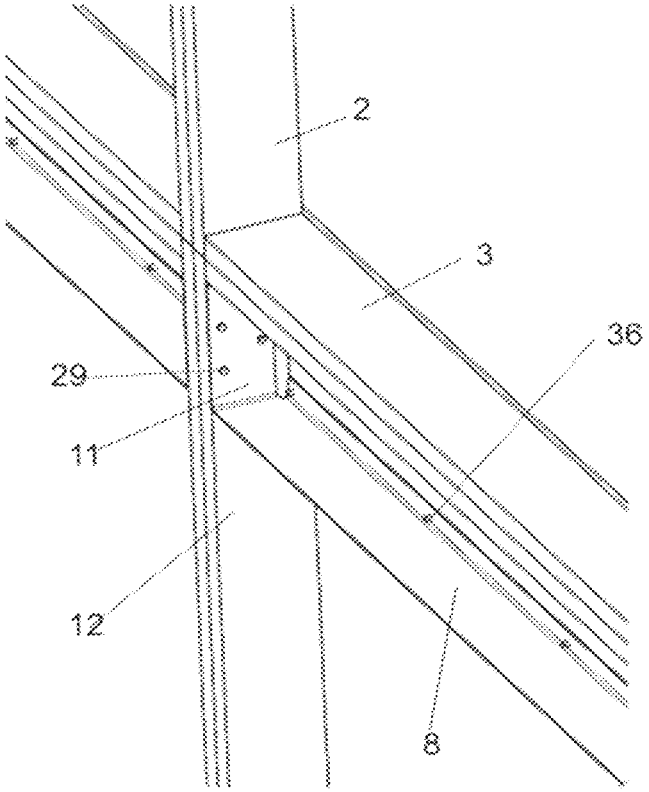
FIG. 12 shows a perspective view of an embodiment of the first and fourth element of the dynamic, thermally insulating and sealing system installed to the vertical framing member (mullion) and to the horizontal framing member (transom) within the zero-spandrel area of a curtain wall structure.

FIG. 12 shows a perspective view of an embodiment of the first 8 and fourth element 9 of the dynamic, thermally insulating and sealing system as described for FIGS. 3 and 4, installed to the vertical framing member 2 and to the horizontal framing member 3 within the zero-spandrel area of a curtain wall structure.

It should be appreciated that these embodiments of the present invention will work with many different types of insulating materials used for the second element and third element as well as different types of the non-combustible material used for the first and fourth element as long as the material has effective high temperature insulating characteristics. Each unitized panel manufacturer/curtain wall manufacturer/constructor has its own architectural design, which requires minor adjustments to the construction process. These include but are not limited to the water-tight gaskets, anchor bracket attachment method, and mullion/transom design.

The dynamic, thermally insulating and sealing system of the present application has been subject to a test according to standard method ASTM E 2307, Standard Test Method for Determining Fire Resistance of Perimeter Fire Barriers Using Intermediate-Scale, Multi-story Apparatus, 2015, and to a test according to standard method ASTM Designation: E 1399-2013, Standard Test Method for Cyclic Movement and Measuring the Minimum and Maximum Joint Widths of Architectural Joint Systems, (Intertek Design No. HI-BPF 120-11) as follows:

Elements and Assembly Description

1. Concrete Slab (Floor. 2-Hour Fire-Rating):

6 inch thick (min. 5¼ inch thick) reinforced normal weight 3000 psi concrete slab. There was a 4 inch open joint (safing slot) from wall to slab. In particular, the two hour rated concrete floor assembly is made from either lightweight or normal weight concrete with a density of 100-150 pcf, with a min. thickness of 4 inch at the joint face. Overall slab thickness may vary to accommodate various blockout depths (longitudinal recesses) formed in the concrete, to house the architectural cover plate. The blockout width may also vary without restriction.

2. Curtain Wall (Non Fire-Rated, 0 Hours Fire-Rated):

Curtain wall constructed of rectangular hollow tubing 2½ inch wide and 4 inch deep (total depth of wall including ¼ inch glass and ½ inch aluminum cap is 5¼ inch), made from 0.1 inch thick aluminum (framing members). ¼ inch thick tempered glass (vision glass) was installed in place with aluminum compression plates (caps) and glazing gaskets. In particular, rectangular aluminum tubing mullions and transoms are sized according to the curtain wall system manufacturers guidelines. Min. overall dimensions of the extruded framing sections are 0.100 inch thick aluminum with a min. 3¾ inch depth and a min. of 2½ inch width. Mullion and transom covers are added to the external side of the framing, giving the framing system a total depth of nominal 5-¼ inch Mullions are to be spaced a min. 60 in. on center (oc). For the spandrel region, the bottom surface of the transom is located flush with the top surface of the floor. For the vision glass, in particular a min. ¼ inch thick, clear heat-strengthened (HS) glass, or tempered glass with a max. width and height less than the aluminum framing oc spacing which allows the glass to be secured between the notched shoulder of the aluminum framing and pressure bar is used. Panels are secured with a thermal break (rubber extrusion), pressure bar (aluminum extrusion), min. ¼-20×⅝ inch long screws, and a snap face (aluminum extrusion).

3. Galvanized Sheet Metal Pan (First Element and Fourth Element—Zero Spandrel Box or 5-Sided Box Dan):

Galvanized steel pan made from 18 gauge galvanized steel was attached to the aluminum framing with No. 10 self-drilling sheet metal screws, such as #10 hex-head self-drilling self-tapping sheet metal screws, to the bottom of the horizontal framing member and to the inner facing side of the vertical framing member. The galvanized steel pan was formed such that it could contain 3 inch of curtain wall insulation (third element). The steel pan was created from two L-shaped members, having dimensions of 3×6 inch, 3×1 inch, respectively, not fastened to the concrete slab. In particular, the 5-sided box pan is 3 inch deep×6 inch high, fabricated from galvanized or plain steel and is placed between mullions for the entire length of the perimeter fire barrier, with the open side toward the concrete floor assembly and flush with the interior face of the transom. The box pan sections are secured to the underside of the transoms in the aluminum framing. The box pan is secured with ¾ inch long No. 10 self-drilling sheet metal screws, preferably #10 hex-head self-drilling self-tapping sheet metal screws, spaced max. 12 inch oc and 1 inch inboard of the joint opening. Two additional ¾ inch long No. 10 self-drilling sheet metal screws, preferably #10 hex-head self-drilling self-tapping sheet metal screws, are installed through the vertical ends of the box pan into the adjacent mullions of the aluminum framing.

4. Curtain Wall Insulation (Second Element):

3 inch thick, 6 inch tall sections of 8-pcf density mineral wool with foil face removed—unfaced curtain wall insulation (second element) (Thermafiber Firespan)—were installed into the zero spandrel box (first element) along the length of the curtain wall assembly between the aluminum mullions (vertical framing members). In particular, the box pan sections are filled to a depth of 2⅞ inch with 4 pcf density, mineral wool batt insulation installed with the fibers running parallel to the floor and the packing material is compressed 25% vertically in the box pan.

5. Joint Packing Material (Third Element):

4 inch thick mineral wool of 4-pcf density (Thermafiber Firespan) was packed into the width of the joint flush with the top surface of the floor at ~25% compression and installed with the fibers running parallel to the slab edge and curtain wall and the packing material is compressed 25% in the nominal joint width. Strips were installed so that the factory compressed layers of the safing were parallel to the horizontal face of the slab edge. The batt insulation is compressed into the perimeter joint flush with the top surface of the concrete floor slab and its mid-depth is compressed against the interior surface of the insulation-filled box pan. Splices (butt joints) in the lengths of mineral wool batt insulation are to be tightly compressed together.

6. Fill. Void or Cavity Material (Outer Fire Retardant Coating):

A min. ⅛ inch wet film thickness of Hilti Firestop Joint Spray CFS-SP WB was sprayed over top of the joint packing material and overlapped the top surface concrete slab with a min. of ½ inch and the interior face of aluminum curtain wall framing member overlapping onto the aluminum members at least ½ inch. If the spraying process is stopped and the applied liquid spray material cures to an elastomeric film before process is restarted, then the edge of the cured spray material is to be overlap at least ⅛ inch with the liquid spray material.

7. Mounting Attachment:

Attach aluminum framing to the structure framing according to the curtain wall manufacturer's instructions connect the mounting attachments to the joint face of the concrete floor assembly according to the curtain wall manufacturers instructions. However, attachments are secured to each mullion in the perimeter joint protection region at a max. spacing of 60 inch oc.

Testing and Evaluation Methods

1. ASTM E 2307:

Instrumentation:

Thirty-five (35) 24 GA, Type K, fiberglass jacketed thermocouples (TCs) were installed in compliance with the standard: 12 TCs measured the temperature up to the center of the exterior, 11 TCs measured the temperatures on the perimeter joint and the supporting frame, and 12 TCs measured fumace temperatures. The output of the thermocouples was monitored by a 100-channel Yokogawa, Inc., Darwin Data Acquisition Unit. The computer was programmed to scan and save data every 15 seconds.

Test Standard:

Testing was conducted in accordance with the applicable requirements, and following the standard method of ASTM E 2307, Standard Test Method for Determining Fire Resistance of Perimeter Fire Barriers Using Intermediate-Scale, Multi-story Apparatus, 2015.

The assembly was secured to the test laboratory's Intermediate-Scale, Multi-story Test Apparatus (ISMA), with ceramic fiber insulation installed between the assembly and the fumace to create an effective seal. The window burner was centered on the vertical centerline of the window, 9 inch below the top of the opening, and with the longitudinal centerline of the burner 3 inch from the plane of the exterior wall, consistent with the standard and the calibration of the test apparatus. The assembly was tested using commercial grade propane gas at the flow rates determined during calibration of the apparatus.

2. ASTM E 1399:

Instrumentation:

A welded steel testing apparatus in combination with hydraulic cylinders, was used to cycle the test specimen to a specified maximum and minimum joint width and with the required number of continuous repetitious movements, in accordance to the desired movement classification. The joint width displacement output was calibrated with predetermined hardware locations and monitored to an accuracy of 0.25±0.013 mm (0.010±0.005 in.).

Test Standard:

Testing was conducted in accordance with the applicable requirements, and following the standard method of ASTM Designation: E 1399-2013, Standard Test Method for Cyclic Movement and Measuring the Minimum and Maximum Joint Widths of Architectural Joint Systems.

The assembly was secured to the test laboratory's Intermediate-Scale, Multi-story Test Apparatus (ISMA), with a combination of various hardware and threaded rods. The hydraulic cylinders were centered with the assembly so that a consistent and uniform load distribution was applied to the testing specimen. The hydraulic cylinders were attached to the predetermined locations on the ISMA to accomplish the desired movement classes in the vertical and horizontal directions.

Cycling was performed by applying a minimum number of cycles 100 with cycling rates greater or equal to 30 cpm followed by a minimum number of cycles 400 with cycling rates greater or equal to 10 cpm, to comply with the requirements for a class IV movement rating according to ASTM E 1399.

Testing and Evaluation Results

The ambient temperature at the time of the test was 73° F. and the humidity was 76% R.H. The test was conducted for 130 min. Transmission of heat through the fire barrier during the test did raise the average temperature on the unexposed surface more than 250° F. and raised the individual temperature more than 325° F. The average temperature limit was exceeded after 104 min. and the single point limit was exceeded after 45 min. The perimeter fire barrier did not allow the passage of flames throughout the duration of the test.

A comprehensive cycle test was conducted on the test specimen assembly using the ISMA. The test specimen was cycled in both the horizontal and vertical directions with an amplitude of 0.5 inch and 0.375 inch, respectively. Throughout the duration of the test, the test specimens did not show any of the listed types of failures described in ASTM E 1399.

Based on the results of these tests, the test assembly achieved a T-Rating of 45 min. and an F-Rating of 120 min as well as a movement rating of class IV.

It has been shown, that the dynamic, thermally insulating and sealing system of the present invention for sealing between the edge of a floor and an interior wall surface of a glass curtain wall construction maintains sealing of the safing slots surrounding the floor of each level in a building.

It has been demonstrated that the dynamic, thermally insulating and sealing system for a glass curtain wall structure of the present invention is capable of meeting or exceeding existing fire test and building code requirements including existing exceptions. In particular, the system prevents the spread of fire when vision glass of a curtain wall structure extends to the finished floor level below, thereby addressing the architectural limitation of the width of a column or spandrel beam or shear wall behind the curtain wall. Additionally, maintaining safing insulation between the floors of a residential or commercial building and the exterior curtain wall responsive to various conditions including fire exposure is guaranteed.

Further, it has been shown, that the dynamic, thermally insulating and sealing system of the present invention meets the requirements of a full-scale ASTM E 2307 as well as full-scale ASTM E 1399 tested system for floor assemblies where the vision glass extends to the finished floor level, addressing the code exception, avoiding letters and engineering judgments and securing and providing defined/tested architectural detail for this application, in particular providing a tested system for fire- and movement-safe architectural compartmentation.

In particular, the system has been rated for ±12.5% horizontal movement at 25% compression.

The tested system according to the present invention can be pre-installed from one side, which maintains the safing insulation between the floors of a residential or commercial building and the glass curtain wall responsive to various conditions, including fire exposure and exposure to movement, and maximizes safing insulation at a minimal cost. The system can be easily installed within a safing slot, where, for example, access is only needed from one side, implementing a one-sided application.

In particular, the tested system according to the present invention provides for the employment of reduced curtain wall insulation to only 6 inch height, resulting in up to 40% curtain wall material savings to the closest 10 inch spandrel system. Further, no top horizontal transom cover is needed for maximum vision glass/architectural exposure top of slab. Another great advantage of the dynamic, thermally insulating and sealing system of the present invention is that mineral wool is not exposed and does not need to be superior water resistant from all directions, no fiber distribution can occur to the air and no mineral wool is visible for architectural looks. Further, no stiffeners, hat channel, weld pins or similar means are needed to install/fasten the insulation, rather it can be simply fitted by friction fit. Additionally, the mineral wool is installed with only 25% compression, whereas standard systems require 33% compression.

It has been also shown that a building construction is provided comprising such a dynamic, thermally insulating and sealing system for effectively thermally insulating and sealing of the safing slot between a glass curtain wall structure and the edge of a floor, in particular within the zero spandrel area, wherein the vision glass of a curtain wall structure extends to the finished floor level below, thereby creating a continuous fireproofing seal extending from the outermost edge of the floor to the curtain wall structure and, in particular, to abutment with the interior wall surface.

Further, the dynamic, thermally insulating and sealing system is not limited to a specific joint width or spandrel height; installation on the face of the transom is possible.

It has been shown that the system can be installed into a unitized panel, making it easier for the installers to build up the curtain wall on the jobsite. A unitized curtain wall panel production allows the curtain wall manufacturers to install all required curtain wall components off site and then ship the complete unitized panel onsite for an easy quick installation on to the building.

As such, the dynamic, thermally insulating and sealing system of the present invention provides a system for effectively maintaining a complete seal in a safing slot when utilizing a glass curtain wall construction, vision glass extends to the finished floor level below.

The curtain wall design of the present invention clearly simplifies fire protection installation and can be used to add additional insulation for other mechanical purposes, such as for example STC, R-value, and the like.

Finally, it has been shown that the dynamic, thermally insulating and sealing system according to the present invention is also for acoustically insulating and sealing of a safing slot of a curtain wall structure.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A dynamic, thermally insulating and sealing system for effectively thermally insulating and sealing of a safing slat within a building construction, having a curtain wall construction, defined by an interior wall surface including at least one vertical framing member and at least one horizontal framing member and at least one floor spatially disposed from the interior wall surface of the curtain wall construction, thereby defining the safing slot extending between the interior wall surface of the curtain Nall construction and an outer edge of the floor, the system comprising:

a first element comprised of a non-combustible material for receiving a thermally resistant material for insulating, wherein the first element has a cavity-shaped profile, the first element comprising:

a web section having opposing edges and an inner and an outer surface;

a pair of outwardly extending side sections connected to the web section, wherein each side section has an outer and an inner surface, a proximal end and a distal end, wherein the proximal end of each side section is connected to one of the opposing edges of the web section, and wherein the side sections are substantially parallel and confront each other; and at least one supplemental element for attaching of the first element with respect to a bottom side of the horizontal framing member of the curtain wall construction, a second element comprised of a thermally resistant material for insulating, positioned in the first element, wherein the second element includes:

an outer primary end surface positionable in abutment with respect to the inner surface of the web section of the first element;

an inner primary end surface positionable spatially disposed from the outer edge of the floor for sealing thereadjacent; and a lower primary surface and an upper primary surface extending between the proximal and distal ends of the pair of the outwardly extending sidewalls of the first element and in abutment with respect to the inner surface of each of the outwardly extending side sections, a third element comprised of a thermally resistant material for insulating, positioned in the safing slot, wherein the third element includes:

an inner primary end surface positionable in abutment with respect to the outer edge of the floor for sealing thereadjacent;

an outer primary end surface positioned in abutment with respect to the inner primary end surface of the second element and spatially disposed from the inner surface of the web section of the first element; and a lower primary surface and an upper primary surface extending between the distal end of each of the outwardly extending sidewalls of the first element and the outer edge of the floor, and a fourth element for supporting and attaching the first element with respect to an inner facing side of the vertical framing member of the curtain wall construction, wherein the first element and the fourth element form a 5-sided box pan.

2. The dynamic, thermally insulating and sealing system according to claim 1, wherein the framing members define a perimeter fire barrier, wherein the 5-sided box pan is placed between the vertical framing members for the entire length of the perimeter fire barrier, with an open side toward the at least one floor and flush with an interior face of the horizontal framing member.

3. The dynamic, thermally insulating and sealing system according to claim 1, wherein the cavity-shaped profile is a substantially U-shaped profile.

4. The dynamic, thermally insulating and sealing system according to claim 1, wherein the critain wall construction is comprised of:

a vision glass infill, at least one vertical metal framing member, and at least one horizontal metal framing member.

5. The dynamic, thermally insulating and sealing system according to claim 4, wherein the outer surface of the web section of the first element is positioned spatially disposed from the inner surface of the vision glass infill.

6. The dynamic, thermally insulating and sealing system according to claim 1, wherein the first element is comprised of a metal material.

7. The dynamic, thermally insulating and sealing system according to claim 6, wherein the first element is comprised of steel.

8. The dynamic, thermally insulating and sealing system according to claim 6, wherein the metal material is an 18 gauge galvanized steel material.

9. The dynamic, thermally insulating and sealing system according to claim 1, wherein the first element consists of a first L-shaped member and a second L-shaped member connected to each other to form the cavity-shaped profile of the first element.

10. The dynamic, thermally insulating and sealing system according to claim 1, wherein the second element and the third element each comprise a thermally resistant flexible mineral wool material to facilitate placement thereof into the sating slot and the cavity-shaped profile of the first element adjacent one another.

11. The dynamic, thermally insulating and sealing system according to claim 1, wherein the elements for attaching are selected from the group consisting of pins, expansion anchors, screws, screw anchors, bolts and adhesion anchors.

12. The dynamic, thermally insulating and sealing system according to claim 1, wherein the at least one supplemental element for attaching extends through the upper outwardly extending side section of the first element and is attached to the bottom side of the horizontal framing member of the curtain wall construction.

13. The dynamic, thermally insulating and sealing system according to claim 1, further comprising:

an outer fire retardant coating, positioned across the third element and to the adjacent portions of the at least one vertical framing member and the at least one horizontal framing member of the curtain wall construction and the floor located thereadjacent.

14. The dynamic, thermally insulating and sealing system according to claim 13, wherein the outer fire retardant coating has a wet film thickness of at least ⅛ inch.

15. The dynamic, thermally insulating and sealing system according to claim 10, wherein the thermally resistant flexible mineral wool material of the second element is a mineral wool hat insulation having a 3 inch thickness, 8-pcf density, installed with no compression, and/or wherein the thermally resistant flexible mineral wool of the third element is a mineral wool bat insulation having 4 inch thickness, 4-pcf density, installed with 25% compression, as compared to the third element when uncompressed.

16. The dynamic, thermally insulating and sealing system according to claim 1, wherein the outer surface of the web section of the first element is positioned spatially disposed from the interior wall surface of the curtain wall construction.

17. A building construction, having:

a curtain wall construction defined by an interior wall surface including one or more framing members and at least one floor spatially disposed from the interior wall surface of the curtain wall construction, thereby defining a safing slot, extending between the interior wall surface of the curtain wall construction and an outer edge of the floor, wherein the curtain wall construction comprises a dynamic, thermally insulating and sealing system for effectively thermally insulating and sealing of the safing slot, wherein the dynamic, thermally insulating and sealing system comprises:

a first element comprised of a non-combustible material for receiving a thermally resistant material for insulating, wherein the first element has a cavity-shaped profile, the first element comprising:

a web section having opposing edges and an inner and an outer surface;

a pair of outwardly extending side sections connected to the web section, wherein each side section has an outer and an inner surface, a proximal end and a distal end, wherein the proximal end of each side section is connected to one of the opposing edges of the web section, and wherein the side sections are substantially parallel and confront each other; and at least one supplemental element for attaching of the first element with respect to a bottom side of the horizontal framing member of the curtain wall construction, a second element comprised of a thermally resistant material for insulating, positioned in the first element, wherein the second element includes:

an outer primary end surface positionable in abutment with respect to the inner surface of the web section of the first element;

an inner primary end surface positionable spatially disposed from the outer edge of the floor for sealing thereadjacent; and a lower primary surface and an upper primary surface extending between the proximal and distal ends of the pair of the outwardly extending sidewalls of the first element and in abutment with respect to the inner surface of each of the outwardly extending side sections, a third element comprised of a thermally resistant material for insulating, positioned in the sating slot, wherein the third element includes:

an inner primary end surface positionable in abutment with respect to the outer edge of the floor for sealing thereadjacent;

an outer primary end surface positioned in abutment with respect to the inner primary end surface of the second element and spatially disposed from the inner surface of the web section of the first element; and a lower primary surface and an upper primary surface extending between the distal end of each of the outwardly extending sidewalk of the first element and the outer edge of the floor;

a fourth element for supporting and attaching the first element with respect to an inner facing side of the vertical framing member of the curtain wall construction, wherein the fourth element has a substantially L-shaped profile and includes elements for attachment, wherein the first element and the fourth element form a 5-sided box pan; and an outer fire retardant coating, positioned across the first element, and to the adjacent portions of the interior framing member of the curtain wall construction and the floor located thereadjacent.

18. A process for assembling a unitized panel for use within an exterior dynamic curtain wall, comprising:

assembling a frame for the unitized panel by fastening left and right vertical framing members and upper and lower horizontal framing members together;

installing anchor brackets to the upper locations of the vertical framing members ready for mounting the unitized panel to a building structure;

installing appropriate water gasket seals to the framing members to seal the unitized panel and building structure from water intrusion;

installing the dynamic, thermally insulating and sealing system as defined in claim 2, wherein the first element and the fourth element form a 5-sided box pan that is placed and fastened between the vertical framing members for the entire length of the perimeter fire harrier, with an open side toward at least one floor and flush with an interior face of the horizontal framing member;

installing at least one additional element selected from the group consisting of gaskets, hardware, and components necessary to prepare the unitized panel for glass installation;

completing the unitized panel by installing glass and one or more appropriate sealing layers to the unitized panel; and optionally installing a thermally resistant material into the 5-sided box pan.

19. A process for assembling a fireproof system within a stick build exterior dynamic curtain wall façade, the process comprising:

assembling a framing structure by attaching anchoring brackets to horizontal and vertical framing members and to concrete and steel members of the stick build exterior dynamic curtain wall façade of a building structure;

installing appropriate water gasket seals to the framing members to seal the framing structure and building structure from water intrusion;

installing the dynamic, thermally insulating and sealing system as defined in claim 2, wherein the first element and the fourth element form a 5-sided box pan that is placed and fastened between the vertical framing members for the entire length of the perimeter fire barrier, with an open side toward at least one floor and flush with an interior face of the horizontal framing member;

installing at least one additional element selected from the group consisting of gaskets, hardware, and components necessary to prepare the framing structure for glass installation;

completing the stick build exterior curtain wall façade by installing glass and one or more appropriate sealing layers to the stick build exterior curtain wall façade;

installing a thermally resistant material into the 5-sided box pan and the sating slot; and optionally applying an outer tire retardant coating, positioned across the thermally resistant material installed in the safing slat and to the adjacent portions of the vertical and horizontal framing members and the floor located thereadjacent.

20. A pre-fabricated device for sealing a sating slot in a curtain wall construction, the pre-fabricated device comprising:

a first element comprised of a non-combustible material for receiving a thermally resistant material for insulating, wherein the first element has a cavity-shaped profile, the first element comprising:

a web section having opposing edges and an inner and an outer surface;

a pair of otnwardly extending side sections connected to the web section, wherein each side section has an outer and an inner surface, a proximal end, and a distal end, wherein the proximal end of each side section is connected to one of the opposing edges of the web section, and wherein the side sections are substantially parallel and confront each other; and at least one supplemental element for attaching of the first element with respect to a bottom side of a horizontal framing member of the curtain wall construction, and a second element comprised of a thermally resistant material for insulating, positioned in the first element, wherein the second element includes:

an outer primary end surface positionable in abutment with respect to the inner surface of the web section of the first element;

an inner primary end surface positionable spatially disposed from an outer edge of a floor of the curtain wall construction for sealing thereadjacent; and a lower primary surface and an upper primary surface extending between the proximal and distal ends of the pair of the outwardly extending sidewalls of the first element and in abutment with respect to the inner surface of each of the outwardly extending side sections, wherein the pre-fabricated device is comprised within a unitized panel construction.

* * * * *